US011220854B2

(12) United States Patent
Podkopayev

(10) Patent No.: US 11,220,854 B2
(45) Date of Patent: Jan. 11, 2022

(54) POWER SWING DOOR ACTUATOR WITH INTEGRATED DOOR CHECK MECHANISM

(71) Applicant: Magna Closures Inc., Newmarket (CA)

(72) Inventor: Vadym Podkopayev, Barrie (CA)

(73) Assignee: MAGNA CLOSURES INC., Newmarket (CA)

( * ) Notice: Subject to any disclaimer, the term of this patent is extended or adjusted under 35 U.S.C. 154(b) by 0 days.

(21) Appl. No.: 16/898,752

(22) Filed: Jun. 11, 2020

(65) Prior Publication Data

US 2020/0300022 A1 Sep. 24, 2020

Related U.S. Application Data

(63) Continuation of application No. 15/473,727, filed on Mar. 30, 2017, now Pat. No. 10,683,691.

(60) Provisional application No. 62/319,560, filed on Apr. 7, 2016, provisional application No. 62/372,502, filed on Aug. 9, 2016.

(51) Int. Cl.

| | |
|---|---|
| ***E05F 15/622*** | (2015.01) |
| ***E05C 17/04*** | (2006.01) |
| ***E05C 17/20*** | (2006.01) |
| ***E05C 17/00*** | (2006.01) |
| *E05F 15/73* | (2015.01) |

(52) U.S. Cl.

CPC ..... *E05F 15/622* (2015.01); *E05C 17/003* (2013.01); *E05C 17/006* (2013.01); *E05C 17/04* (2013.01); *E05C 17/203* (2013.01); *E05F 15/73* (2015.01); *E05Y 2900/531* (2013.01)

(58) Field of Classification Search

CPC ..... E05F 15/622; E05F 15/73; E05C 17/006; E05C 17/203; E05C 17/003; E05C 17/04; E05Y 2900/531

USPC ..... 49/324, 339–341

See application file for complete search history.

(56) References Cited

U.S. PATENT DOCUMENTS

| | | | |
|---|---|---|---|
| 2,371,336 | A | 3/1945 | Levon |
| 3,398,484 | A | 8/1968 | Katsumura et al. |
| 6,901,630 | B2 | 6/2005 | Liang et al. |
| 7,500,711 | B1 | 3/2009 | Ewing et al. |
| 8,365,470 | B1 | 2/2013 | Campbell et al. |
| 9,174,517 | B2 | 11/2015 | Scheuring et al. |

(Continued)

FOREIGN PATENT DOCUMENTS

| | | | |
|---|---|---|---|
| KR | 20170046860 | A * | 5/2017 |
| WO | 2013013313 | A1 | 1/2013 |

(Continued)

*Primary Examiner* — Brent W Herring

(74) *Attorney, Agent, or Firm* — Dickinson Wright PLLC

(57) ABSTRACT

A power swing door actuator for moving a passenger swing door relative to a body portion of a motor vehicle. The power swing door actuator includes a housing rigidly fixed to the swing door, a motor mounted to the housing, a connector link having a first end pivotably coupled to the vehicle body portion and a second end pivotably coupled to a drive nut of a spindle drive mechanism. A leadscrew of the spindle drive mechanism is rotatably driven by the motor for causing relative translational movement between the drive nut and the leadscrew which, in turn, results in pivoting movement of the connector link while the vehicle door swings between open and closed positions in response to selective actuation of the motor. The power swing door actuator is further equipped with an integrated door check mechanism.

19 Claims, 23 Drawing Sheets

(56) References Cited

U.S. PATENT DOCUMENTS

| | | | |
|---|---|---|---|
| 9,573,446 | B2 | 2/2017 | Scheuring et al. |
| 10,273,738 | B2 | 4/2019 | Takizawa et al. |
| 2008/0309120 | A1 | 12/2008 | Kohlstrand et al. |
| 2009/0051192 | A1 | 2/2009 | Ewing et al. |
| 2010/0154163 | A1 | 6/2010 | Hoffmann |
| 2013/0074412 | A1 | 3/2013 | Wellborn et al. |
| 2014/0150581 | A1 | 6/2014 | Scheuring et al. |
| 2015/0059250 | A1 | 3/2015 | Miu et al. |
| 2016/0010379 | A1 | 1/2016 | Sauerwein et al. |
| 2016/0052375 | A1 | 2/2016 | Scheuring et al. |
| 2017/0145728 | A1 | 5/2017 | Scheuring et al. |
| 2017/0350175 | A1 | 12/2017 | Hoffmann et al. |
| 2018/0155968 | A1* | 6/2018 | Miu ..... E05C 17/006 |
| 2018/0202203 | A1* | 7/2018 | Miu ..... E05F 5/00 |
| 2018/0223583 | A1 | 8/2018 | Podkopayev |
| 2019/0048637 | A1 | 2/2019 | Wisniewski et al. |
| 2019/0169907 | A1 | 6/2019 | Leonard et al. |

FOREIGN PATENT DOCUMENTS

| | | | |
|---|---|---|---|
| WO | 2016164023 | A1 | 10/2016 |
| WO | 2016164024 | A1 | 10/2016 |

* cited by examiner

POWER SWING DOOR ACTUATOR WITH INTEGRATED DOOR CHECK MECHANISM

CROSS-REFERENCE TO RELATED APPLICATIONS

This application is a continuation of U.S. application Ser. No. 15/473,727, filed on Mar. 30, 2017, which claims the benefit of U.S. Provisional Application No. 62/319,560 filed Apr. 7, 2016 and U.S. Provisional Application No. 62/372,502 filed Aug. 9, 2016. The entire disclosure of each of the above applications is incorporated herein by reference.

BACKGROUND

1. Field of the Invention

The present disclosure relates generally to power door systems for motor vehicles and, more particularly, to a power swing door actuator operable for moving a vehicle door relative to a vehicle body between an open position and a closed position.

2. Related Art

This section provides background information related to the present disclosure which is not necessarily prior art.

The passenger doors on motor vehicles are typically mounted by upper and lower door hinges to the vehicle body for swinging movement about a generally vertical pivot axis. Each door hinge typically includes a door hinge strap connected to the passenger door, a body hinge strap connected to the vehicle body, and a pivot pin arranged to pivotably connect the door hinge strap to the body hinge strap and define the pivot axis. Such swinging passenger doors ("swing doors") have recognized issues such as, for example, when the vehicle is situated on an inclined surface and the swing door either opens too far or swings shut due to the unbalanced weight of the door. To address this issue, most passenger doors have some type of detent or check mechanism integrated into at least one of the door hinges that functions to inhibit uncontrolled swinging movement of the door by positively locating and holding the door in one or more mid-travel positions in addition to a fully-open position. In some high-end vehicles, the door hinge may include an infinite door check mechanism which allows the door to be opened and held in check at any desired open position. One advantage of passenger doors equipped with door hinges having an infinite door check mechanism is that the door can be located and held in any position to avoid contact with adjacent vehicles or structures.

As a further advancement, power door actuation systems have been developed which function to automatically swing the passenger door about its pivot axis between the open and closed positions. Typically, power door actuation systems include a power-operated device such as, for example, an electric motor and a rotary-to-linear conversion device that are operable for converting the rotary output of the electric motor into translational movement of an extensible member. In most arrangements, the electric motor and the conversion device are mounted to the passenger door and the distal end of the extensible member is fixedly secured to the vehicle body. One example of a power door actuation system is shown in commonly-owned U.S. Pat. No. 9,174,517 which discloses a power swing door actuator having a rotary-to-linear conversion device configured to include an externally-threaded leadscrew rotatively driven by the electric motor and an internally-threaded drive nut meshingly engaged with the leadscrew and to which the extensible member is attached. Accordingly, control over the speed and direction of rotation of the leadscrew results in control over the speed and direction of translational movement of the drive nut and the extensible member for controlling swinging movement of the passenger door between its open and closed positions.

While such power door actuation systems function satisfactorily for their intended purpose, one recognized drawback relates to their packaging requirements. Specifically, since power door actuation systems rely on linear motion of the extensible member, the electric motor and conversion device must necessarily be packaged in a generally horizontal orientation within the passenger door and with respect to at least one of the door hinges. As such, the application of such conventional power door actuation systems may be limited, particularly to only those vehicular doors where such an orientation would not cause interference with existing hardware and mechanisms such as for example, the glass window function, the power wiring and harnesses, and the like. Put another way, the translational motion of the extensible member requires the availability of a significant amount of internal space within the cavity of the passenger door.

In view of the above, there remains a need to develop alternative power door actuation systems which address and overcome packaging limitation associated with known power door actuation systems as well as to provide increased applicability while reducing cost and complexity.

SUMMARY

This section provides a general summary of the present disclosure and is not a comprehensive disclosure of its full scope or all of its features, aspects and objectives.

It is an aspect of the present disclosure to provide a power swing door actuator for use in a power swing door actuation system and which is operable for moving a vehicle door between open and closed positions relative to a vehicle body.

It is another aspect of the present disclosure to provide a power swing door actuator for use with swing doors in motor vehicles which can be effectively packaged within the cavity of the door and cooperatively interact with a door hinge.

It is a related aspect of the present disclosure to provide a power swing door actuator having a mounting unit secured to the vehicle door, a power-operated drive mechanism supported by the mounting unit and having an extensible actuation member, and a pivot linkage mechanism arranged to pivotably connect the extensible actuation member to the vehicle body.

It is a further related aspect of the present disclosure to provide the power-operated drive mechanism with a motor-driven spindle unit configured to convert rotation of a rotary drive member into linear movement of the extensible actuation member. In addition, the pivot linkage mechanism includes an elongated connector link having a first link segment pivotably connected to the extensible actuation member and a second link segment pivotably connected to a pivot bracket mounted to the vehicle body.

It is another aspect of the present disclosure to provide a power swing door actuator having a door check mechanism operably disposed between the connector link of the pivot linkage mechanism and the vehicle door.

It is a related aspect to install a door check detent pad to the connector link having a plurality of distinct detents configured to be engaged by a door-mounted check feature to define a corresponding number of intermediate held open positions for the vehicle door.

It is another aspect of the present disclosure to provide a power swing door actuator having a door check mechanism operably disposed between the extensible actuation member of the spindle drive unit and an actuator housing fixed to the vehicle door.

It is a related aspect to install a pair of elongated spring elements within the actuator housing which together define a plurality of distinct detents configured to be engaged by a detent pin extending from the extensible actuation member to define a corresponding number of intermediate held open positions for the vehicle door.

It is another related aspect to install a pair of spring-loaded detent followers on the connector link which move within contoured guide channels formed in the actuator housing and define a plurality of distinct door check detents configured to engage and retain the detent followers to define a corresponding number of intermediate held open positions for the vehicle door.

In accordance with these and other aspects, the power swing door actuator of the present disclosure is configured for use in a power door actuation system in a motor vehicle having a vehicle body defining a door opening and a vehicle door pivotably connected to the vehicle body for movement along a swing path between open and closed positions. The power swing door actuator includes a power-operated drive mechanism connected to the vehicle door and having a linearly moveable actuation member, and an articulating pivot linkage mechanism pivotably connecting the actuation member to the vehicle body. Linear movement of the actuation member in a first direction causes the vehicle door to move in an opening direction from the closed position toward the open position while linear movement of the actuation member in a second direction causes the vehicle door to move in a closing direction from the open position toward the closed position. The pivot linkage mechanism is operable to accommodate pivotal movement of the vehicle door along its swing path in cooperation with bi-directional linear movement of the actuation member.

In accordance with one embodiment of the power swing door actuator, the power-operated drive mechanism includes a mounting unit fixedly secured to the vehicle door, an electric motor supported by the mounting unit, and a spindle drive unit having a rotary leadscrew and a non-rotary, linearly-moveable drive nut defining the actuation member. The pivot linkage mechanism includes a connector link having a first link segment pivotably mounted to the drive nut and a second link segment pivotably mounted to a pivot bracket fixedly secured to the vehicle body. In operation, motor-driven rotation of the leadscrew in a first rotary direction causes translational movement of the drive nut from a retracted position toward an extended position for moving the vehicle door from the closed position toward the open position. Motor-driven rotation of the leadscrew in a second rotary direction causes translational movement of the drive nut from the extended position toward the retracted position for moving the vehicle door from the open position toward the closed position.

In accordance with another embodiment, the power swing door actuator further includes a door check mechanism having a door check pad mounted to, or formed on, the connector link and configured to define a series of detents along its length. Upon movement of the door between its open and closed positions, a door-mounted retention device selectively engages the distinct detents so as to define a corresponding number of door check positions whereat the door is held open via engagement of the retention device within a corresponding one of the detents.

In accordance with yet another embodiment, the power swing door actuator could alternatively further include a door check mechanism having a door check biasing arrangement mounted in the actuator housing and configured to define a series of detents along its length. Upon movement of the door between its open and closed positions, a retention device mounted to the actuation member selectively engages the distinct detents so as to define a corresponding number of door check positions whereat the door is held open.

In accordance with a further embodiment, the power swing door actuator could alternatively include an integrated door check mechanism having a spring-biased follower mounted to the connector link and retained for sliding movement within a corresponding detent guide channel formed in the actuator housing and defining one or more distinct follower retention detents along its length. Upon movement of the vehicle door between its fully-closed and fully-open positions, the follower selectively engages one of the distinct retention detents so as to define a corresponding number of door check positions whereat the door is mechanically held open.

Further areas of applicability will become apparent from the description provided herein. The description and specific embodiments listed in this summary are for purposes of illustration only and are not intended to limit the scope of the present disclosure.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF EXAMPLE EMBODIMENTS

In general, at least one example embodiment of a power door actuation system having a power swing door actuator constructed in accordance with the teachings of the present disclosure will now be disclosed. The at least one example embodiment is provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, will-known device structures, and well-known technologies are described in detail.

Figure 1:
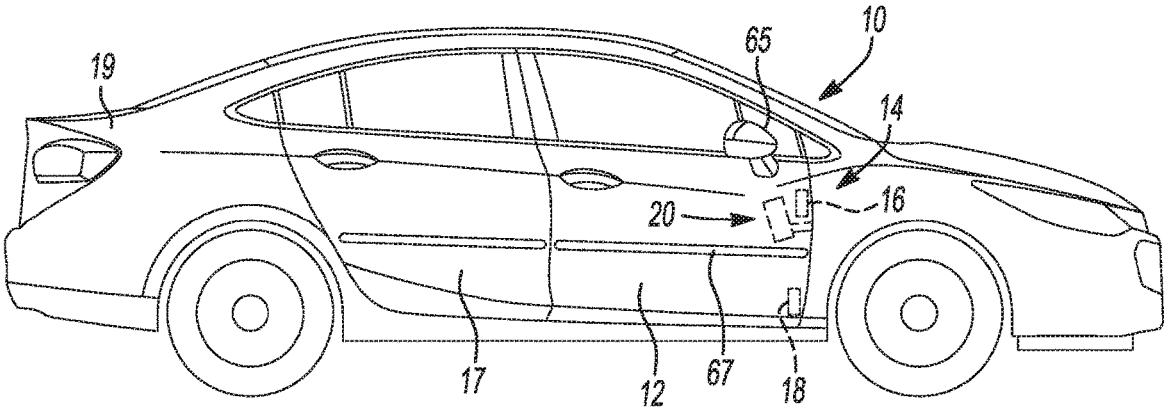
FIG. 1 is a perspective view of an example motor vehicle equipped with a power door actuation system situated between a front passenger swing door and the vehicle body and which is constructed in accordance with the teachings of the present disclosure.

Referring initially to FIG. 1, an example motor vehicle 10 is shown to include a front passenger door 12 pivotally mounted to a vehicle body 14 via an upper door hinge 16 and a lower door hinge 18, which are both shown in phantom lines. In accordance with a general aspect of the present disclosure, a power door actuation system 20, also shown in phantom lines, is integrated into the pivotal connection between front passenger door 12 and a vehicle body 14. In accordance with a preferred configuration, power door actuation system 20 generally includes a power-operated swing door actuator secured within an internal cavity of passenger door 12 and including an electric motor driving a spindle drive mechanism having an extensible component that is pivotable coupled to a portion of the vehicle body 14. Driven rotation of the spindle drive mechanism causes controlled pivotal movement of passenger door 12 relative to vehicle body 14.

Each of upper door hinge 16 and lower door hinge 18 include a door-mounting hinge component and a body-mounted hinge component that are pivotably interconnected by a hinge pin or post. While power door actuation system 20 is only shown in association with front passenger door 12, those skilled in the art will recognize that power door actuation system 20 can also be associated with any other door or liftgate of vehicle 10 such as rear passenger doors 17 and decklid 19.

Figure 2:
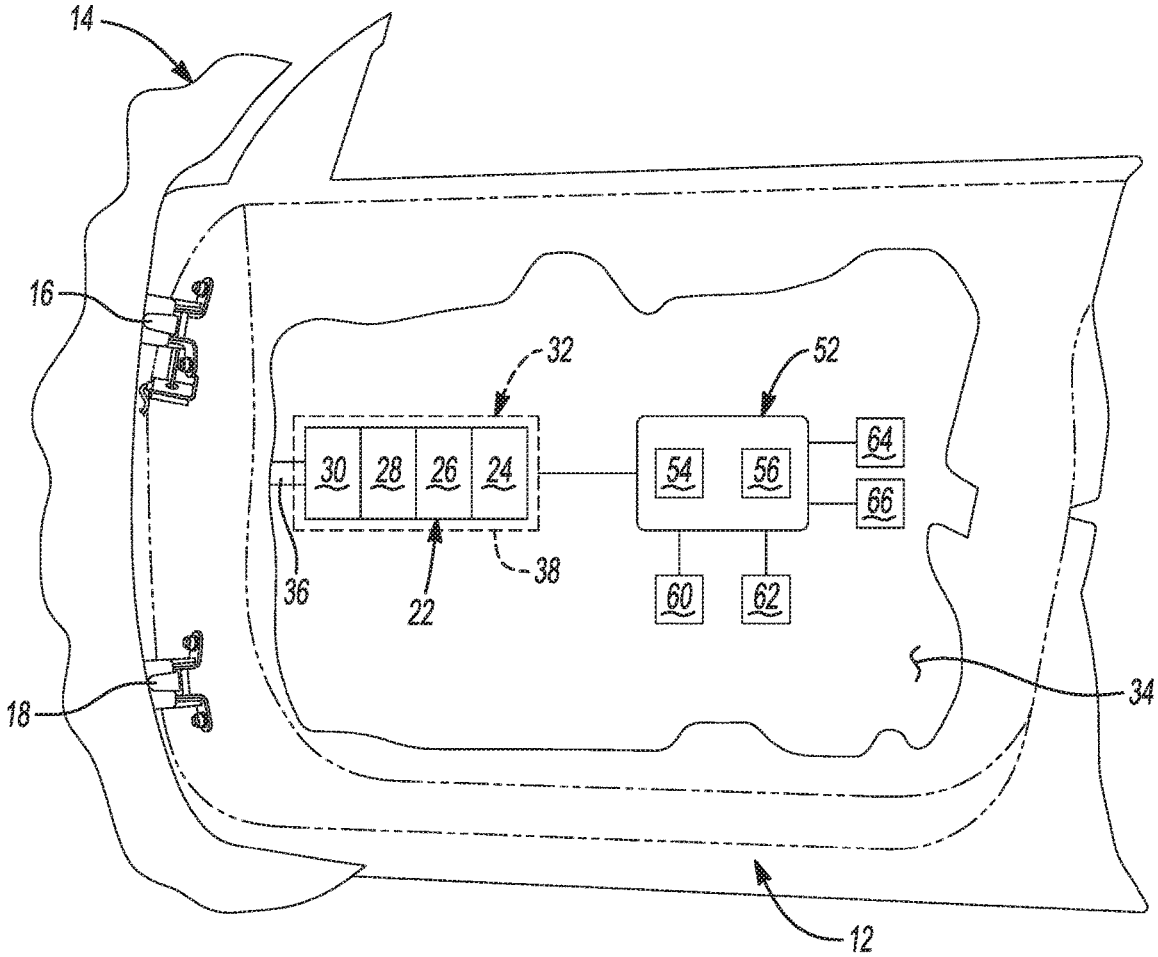
FIG. 2 is a diagrammatic view of the front passenger door shown in FIG. 1, with various components removed for clarity purposes only, in relation to a portion of the vehicle body and which is equipped with the power door actuation system of the present disclosure.

Power door actuation system 20 is diagrammatically shown in FIG. 2 to include a power swing door actuator 22 comprised of an electric motor 24, a reduction geartrain 26, a slip clutch 28, and a drive mechanism 30 which together define a powered door presenter assembly 32 that is mounted within an interior chamber 34 of door 12. Power swing door actuator 22 also includes a connector mechanism 36 configured to connect an extensible member of drive mechanism 30 to vehicle body 14. Power swing door actuator 22 further includes a support structure, such as an actuator housing 38, configured to be secured to door 12 within chamber 34 and to enclose electric motor 24, reduction geartrain 26, slip clutch 28 and drive mechanism 30 therein. As also shown, an electronic control module 52 is in communication with electric motor 24 for providing electric control signals thereto. Electronic control module 52 includes a microprocessor 54 and a memory 56 having executable computer readable instructions stored thereon. Electronic control module 52 can be integrated into, or directly connected to, actuator housing 38.

Although not expressly illustrated, electric motor 24 can include Hall-effect sensors for monitoring a position and speed of vehicle door 12 during movement between its open and closed positions. For example, one or more Hall-effect sensors may be provided and positioned to send signals to electronic control module 52 that are indicative of rotational movement of electric motor 24 and indicative of the rotational speed of electric motor 24, e.g., based on counting signals from the Hall-effect sensor detecting a target on a motor output shaft. In situations where the sensed motor speed is greater than a threshold speed and where the current sensor registers a significant change in the current draw, electronic control module 52 may determine that the user is manually moving door 12 while motor 36 is also operating, thus moving vehicle door 12 between its open and closed positions. Electronic control module 52 may then send a signal to electric motor 24 to stop motor 24 and may even disengage slip clutch 28 (if provided). Conversely, when electronic control module 52 is in a power open or power close mode and the Hall-effect sensors indicate that a speed of electric motor 24 is less than a threshold speed (e.g., zero) and a current spike is registered, electronic control module 52 may determine that an obstacle is in the way of vehicle door 12, in which case the electronic control system may take any suitable action, such as sending a signal to turn off electric motor 36. As such, electronic control module 52 receives feedback from the Hall-effect sensors to ensure that a contact obstacle has not occurred during movement of vehicle door 12 from the closed position to the open position, or vice versa.

As is also schematically shown in FIG. 2, electronic control module 52 can be in communication with a remote key fob 60 and/or with an internal/external handle switch 62 for receiving a request from a user to open or close vehicle door 12. Put another way, electronic control module 52 receives a command signal from either remote key fob 60 and/or internal/external handle switch 62 to initiate an opening or closing of vehicle door 12. Upon receiving a command, electronic control module 52 proceeds to provide a signal to electric motor 24 in the form of a pulse width modulated voltage (for speed control) to turn on motor 24 and initiate pivotal swinging movement of vehicle door 12. While providing the signal, electronic control module 52 also obtains feedback from the Hall-effect sensors of electric motor 24 to ensure that a contact obstacle has not occurred. If no obstacle is present, motor 36 will continue to generate a rotational force to actuate spindle drive mechanism 30. Once vehicle door 12 is positioned at the desired location, motor 24 is turned off and the "self-locking" gearing associated with gearbox 26 causes vehicle door 12 to continue to be held at that location. If a user tries to move vehicle door 12 to a different operating position, electric motor 24 will first resist the user's motion (thereby replicating a door check function) and eventually release and allow the door to move to the newly desired location. Again, once vehicle door 12 is stopped, electronic control module 52 will provide the required power to electric motor 24 to hold it in that position. If the user provides a sufficiently large motion input to vehicle door 12 (i.e., as is the case when the user wants to close the door), electronic control module 52 will recognize this motion via the Hall effect pulses and proceed to execute a full closing operation for vehicle door 12.

Electronic control module 52 can also receive an additional input from an ultrasonic sensor 64 positioned on a portion of vehicle door 12, such as on a door mirror 65 or the like. Ultrasonic sensor 64 assesses if an obstacle, such as another car, tree, or post, is near or in close proximity to vehicle door 12. If such an obstacle is present, ultrasonic sensor 64 will send a signal to electronic control module 52 and electronic control module 52 will proceed to turn off electric motor 24 to stop movement of vehicle door 12, thereby preventing vehicle door 12 from hitting the obstacle. This provides a non-contact obstacle avoidance system. In addition, or optionally, a contact obstacle avoidance system can be placed in vehicle 10 which includes a contact sensor 66 mounted to door, such as in association with molding component 67, and which is operable to send a signal to controller 52.

Figure 3A:
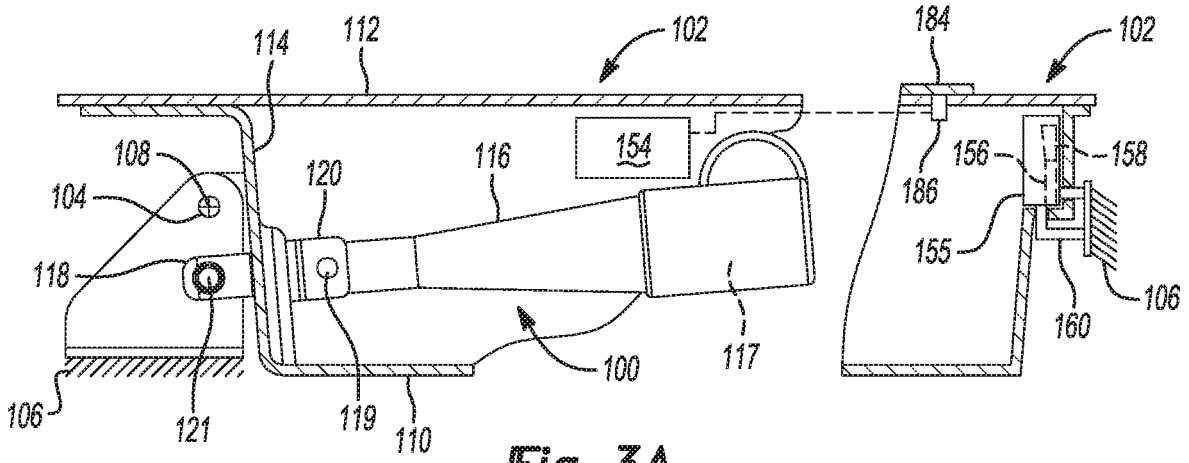
FIGS. 3A, 3B and 3C are schematic views of a power swing door actuator associated with the power door actuation system of the present disclosure and which is operably arranged between the vehicle body and the swing door for moving the swing door between a closed position, one or more mid-positions, and an open position, respectively.
Figure 3B:
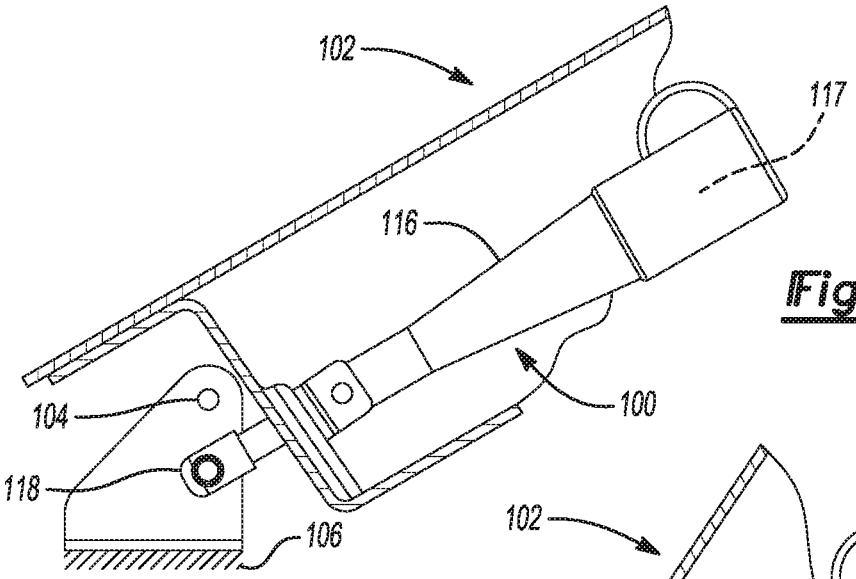
Figure 3C:
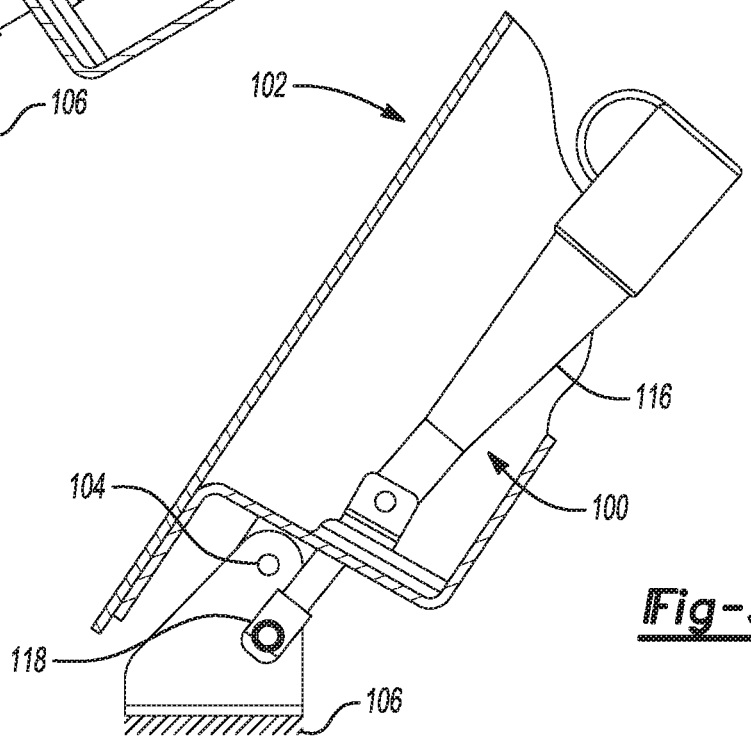

FIGS. 3A, 3B and 3C show a non-limiting embodiment of a power swing door actuator 100 in operation to move a vehicular swing door 102 between a closed position, intermediate open position, and a fully-open position, respectively. The swing door 102 is pivotally mounted on at least one hinge 104 connected to the vehicle body 106 (not shown in its entirety) for rotation about a vertical axis 108. For greater clarity, the vehicle body 106 is intended to include the 'non-moving' structural elements of the vehicle such as the vehicle frame (not shown) and body panels (not shown).

The swing door 102 includes inner and outer sheet metal panels 110 and 112 with a connecting portion 114 between the inner and outer sheet metal panels 110 and 112. The actuator 100 has a support structure, such as a housing 116, a power-operated drive mechanism 117 mounted within housing 116, and an extensible actuation member 118 drivingly coupled to power-operated drive mechanism 117. The extensible actuation member 118 is moveable relative to housing 116 between retracted and extended positions to effectuate swinging movement of door 102. The actuator 100 may be mounted within an internal door cavity formed between the inner and outer sheet metal panels 110, 112. Specifically, the actuator housing 116 is fixed to the swing door 102 via a mounting bracket 120 mounted to the connecting door portion 114 within the internal door cavity. The terminal end of the extensible actuation member 118 is mounted to the vehicle body 106.

Figure 4:
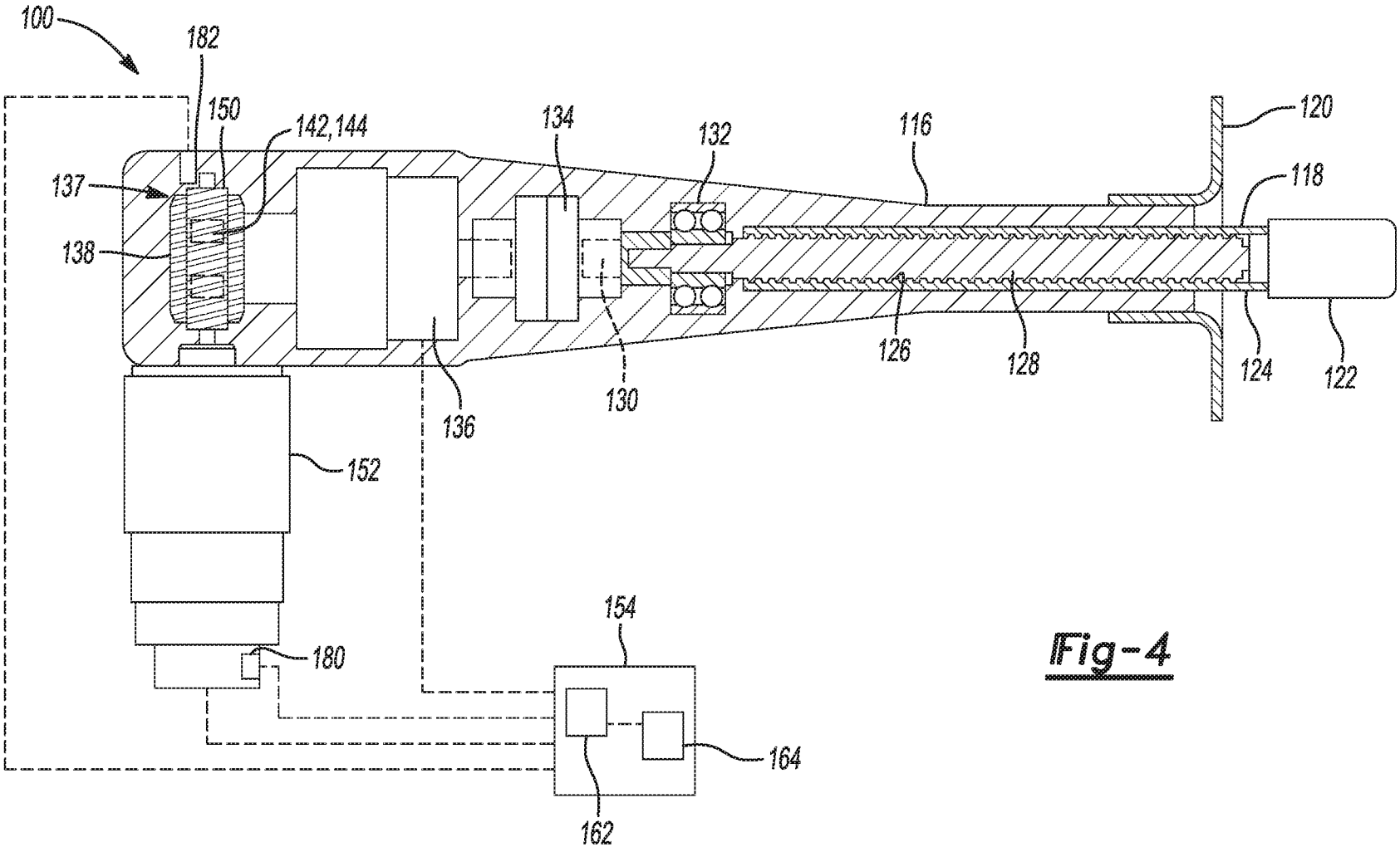
FIG. 4 is a sectional view of the power swing door actuator shown in FIGS. 3A, 3B and 3C.

Referring additionally to the sectional view of the actuator 100 shown in FIG. 4, the housing 116 defines a cylindrical chamber in which the extensible actuation member 118 slides. The extensible actuation member 118 has a ball socket 122 at the terminal end of a cylindrical tube 124 for attachment to the vehicle body 106. The cylindrical tube 124 is formed to include internal threads 126.

The internally-threaded cylindrical tube 124 (also referred to as a "nut tube") meshingly engages with external threads formed on a lead screw 128 that is mounted in the housing 116 for rotation in situ. The lead screw 128 is matable with the internally-threaded nut tube 124 to permit relative rotation between lead screw 128 and the internally-threaded nut tube 124. In the embodiment shown, because the nut tube 124 is slidably connected in the housing 116 but is prevented from rotation, as the lead screw 128 rotates the nut tube 124 translates linearly, thereby causing the extensible actuation member 118 to move with respect to the housing 116. Since the extensible actuation member 118 is connected to the vehicle body 106 and the actuator housing 116 is connected to the swing door 102, such movement of the extensible actuation member 118 causes the swing door 102 to pivot relative to the vehicle body 106.

The lead screw 128 is connected to a shaft 130 that is journalled in the housing 116 via ball bearing 132 that provides radial and linear support for the lead screw. In the illustrated non-limiting embodiment, an absolute position sensor 134 is mounted to the shaft 130. The absolute position sensor 134 translates lead screw rotations into an absolute linear position signal so that the linear position of the extensible actuation member 118 is known with certainty, even upon power up. In alternative embodiments, the absolute linear position sensor 134 can be provided by a linear encoder mounted between the nut tube 124 and actuator housing 116 which reads the travel between these components along a longitudinal axis.

The shaft 130 is connected to a clutch unit 136 associated with power-operated drive mechanism 117. The clutch unit 136 is normally operable in an engaged mode and must be energized to shift into a disengaged mode. In other words, the clutch unit 136 normally couples the lead screw 128 with a geartrain unit 137 without the application of electrical power and the clutch unit 136 requires the application of electrical power to uncouple the lead screw 128 from the geartrain unit 137. The clutch unit 136 may engage and disengage using any suitable type of clutching mechanism, such as a set of sprags, rollers, a wrap-spring, a pair of friction plates, or any other suitable mechanism. The geartrain unit 132 is also part of power-operated drive mechanism 117.

Figure 5A:
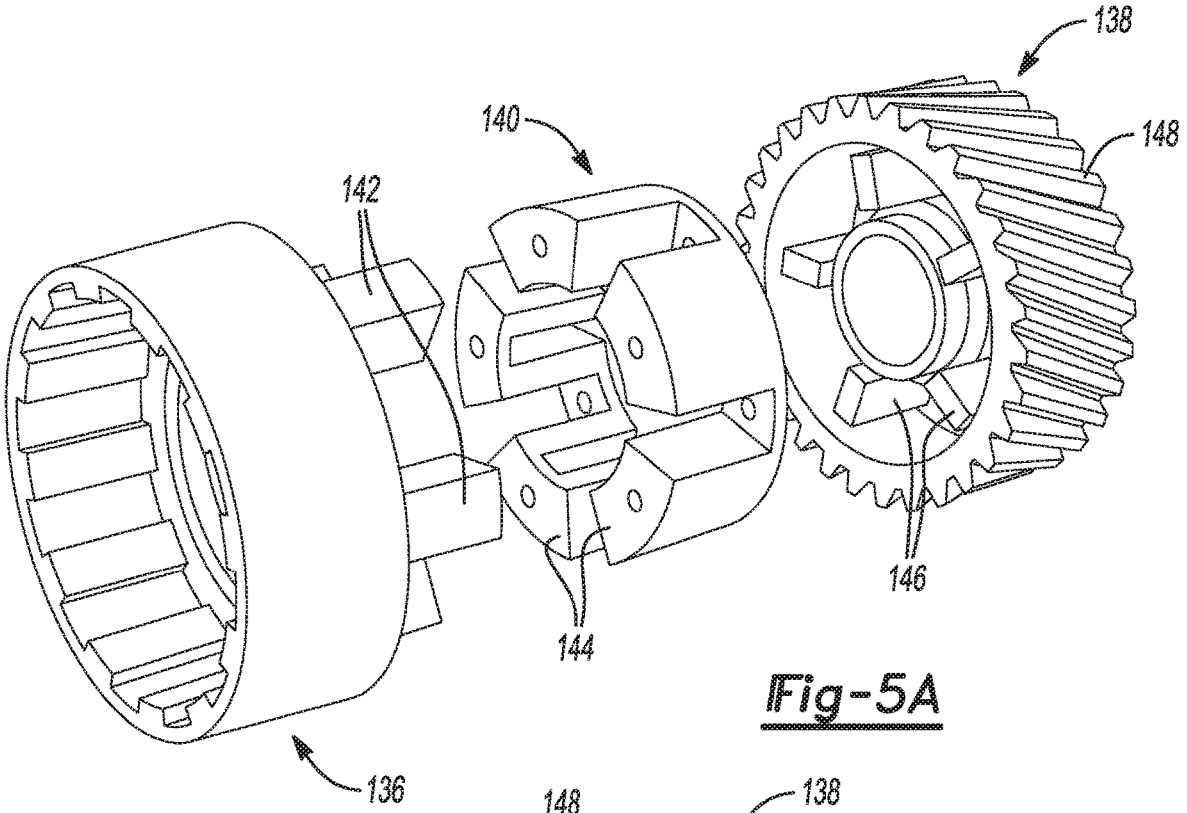
FIGS. 5A and 5B are exploded and assembly views, respectively of a geartrain associated with the swing door actuator shown in FIG. 4.
Figure 5B:
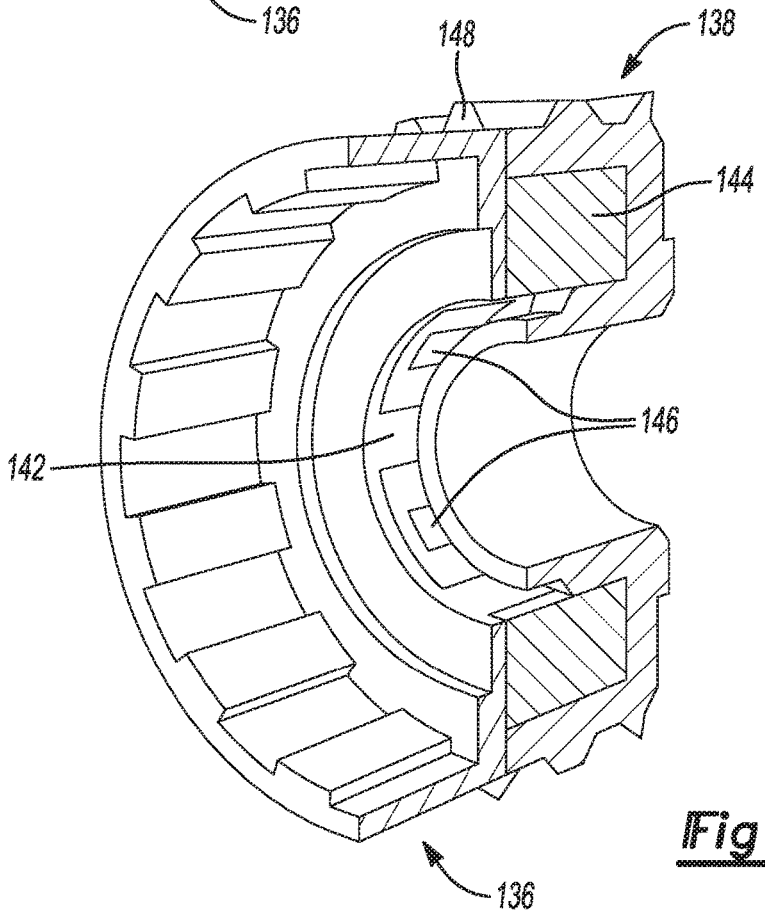

Referring additionally to FIGS. 5A and 5B, the clutch unit 136 is connected to a worm gear 138 via a flexible rubber coupling 140. Clutch unit 136 features a series of lobes 142 that are interdigitated with nodules 144 of the flexible rubber coupling 140 and fins 146 of the worm gear 138. The flexible rubber coupling 140 helps to reduce gear noise by dampening vibrations and minimizing the effects of any misalignment between the clutch unit 136 and the geartrain unit 137.

The worm gear 138 may be a helical gear having gear teeth 148. The worm gear 138 meshes with a worm 150 that is connected to the output shaft of an electric motor 152, which may, for example, be a fractional horsepower motor. The worm 150 may be a single start worm having a thread with a lead angle of less than about 4 degrees. The geartrain unit 137 is thus provided by the worm 150 and worm gear 138 and provides a gear ratio that multiplies the torque of the motor as necessary to drive the lead screw and move the vehicle swing door. The electric motor 152 is operatively connected to the geartrain unit 137 and is operatively connected to an input end 136*a* of the clutch unit 136 through the geartrain unit 137. The output end (shown at 136*b*) of the clutch unit 136 is operatively connected to the extensible actuation member 118 (in the embodiment shown, through the lead screw 128 and nut tube 124). In this non-limiting arrangement, the power-operated drive mechanism 117 includes the electric motor 152, the geartrain unit 137, the clutch unit 136, the position sensor 134, and the spindle drive unit comprised of leadscrew 128 and nut tube 124.

The worm 150 and worm gear 138 provide a locking geartrain, which may also be referred to as a geartrain that is non-back drivable. With the clutch unit 136 normally engaged, a relatively large amount of force is required to back-drive the geartrain unit 137 and motor 152. Thus, the power swing door actuator 100 inherently provides an infinite door check function as the force required to back-drive the geartrain unit 137 and motor 152 will be much larger than the force experienced by an unbalanced door as a result of the vehicle being situated on an incline.

However, the clutch unit 136 has an associated slip torque between the input end 136*a* and the output end 136*b*, that is a maximum amount of torque that the clutch unit 136 will transmit between the input and output ends 136*a* and 136*b* before slipping. Thus, when the clutch unit 136 is engaged, it will slip if a torque is applied at the input end 136*a* (or at the output end 136*b*) that exceeds the slip torque. The slip torque for the clutch unit 136 may be selected to be sufficiently low that, in the event of a power loss in the vehicle that would result in no electric power being available to disengage the clutch 136, the swing door 102 can still be manually moved by a person by overcoming the clutch slip torque. However, the slip torque may be selected to be sufficiently high so that it is sufficient to hold the swing door 102 in whatever position the door 102 is in, thereby providing the infinite door check function. In other words, the slip torque is sufficiently high that, if the swing door 102 is left in a particular position and the motor 152 is stopped, the slip torque will prevent movement of the door when the door is exposed to an external torque that is less than a selected value. An example of an external torque that would not overcome the slip torque would be applied by the weight of the swing door 102 when the vehicle is parked on a surface at less than a selected angle of incline. However, the slip torque is sufficiently low that the swing door 102 can be moved manually by a person (e.g. a person having a selected strength that would be representative of a selected percentage of the overall population in which the vehicle is to be sold).

In normal operation, the power swing door actuator 100 can be disengaged to allow for manual movement of the swing door 102 by applying power (i.e. energizing) to the clutch unit 136, in which case the motor 152 and the geartrain unit 137 will be decoupled from the lead screw 128. An example of a suitable slip torque that may be selected for the clutch unit 136 may be in the range of about 2 Nm to about 4 Nm. The slip torque that is selected for a particular application may depend on one or more of several factors. An example factor based on which the slip torque may be selected is the weight of the door 102. Another example factor based on which the slip torque may be selected is the geometry of the door 102. Yet another example factor based on which the slip torque may be selected is the amount of incline on which the vehicle is intended to be parked while still ensuring that the door 102 is holdable in any position.

In an alternative embodiment, the internally-threaded member 124 and the lead screw 128 associated with the power-operated spindle drive mechanism 117 may be switched in position. That is, the internally-threaded member 124 may be driven by the output end 136*b* of the clutch unit 136 and the externally-threaded lead screw 128 may be slidably connected to the housing 116. Thus, the output end 136*b* of the clutch unit 136 may be connected to either one of the lead screw 128 and the internally threaded member 124 and the other of the lead screw 128 and the internally threaded member 124 may be connected to the extensible actuation member 118 and may thus be slidable relative to the housing 116. Rotation of the output end 136*a* of the clutch unit 136 drives rotation of whichever one of the lead screw 128 and the internally threaded member 124 the output end 136*a* is connected, which in turn drives sliding movement of the other of the lead screw 128 and the internally threaded member 124 relative to the housing 116.

A swing door actuation system is provided that includes the power swing door actuator 100 and a control system 154 shown schematically in FIG. 4. The control system 154 may also be operatively connected to a door latch, shown at 155 in FIG. 3A, that is provided as part of the swing door 102. The door latch 155 may include a latch mechanism having a ratchet 156 and a pawl 158, both of which may be any suitable ratchet and pawl known in the art. The ratchet 156 is movable between a closed position (as shown in FIG. 1A) wherein the ratchet 156 holds a striker 160 that is mounted to the vehicle body 106 and an open position wherein the striker 160 is not held by the ratchet 156. When the ratchet 156 is in the closed position, the door latch 155 may be said to be closed. When the ratchet 156 is in the open position, the door latch 155 may be said to be open. The pawl 158 is movable between a ratchet locking position wherein the pawl 158 holds the ratchet 156 in the closed position and a ratchet release position wherein the pawl 158 permits movement of the ratchet 156 to the open position. Any other suitable components may be provided as part of the door latch 155, such as components for locking and unlocking the swing door 102, and motors for causing movement of the pawl 158 between the ratchet locking and ratchet release positions.

The control system 154 provides system logic for selectively powering the electric motor 152 and the clutch unit 136 based on a number of signal inputs. The control system 154 may include a microprocessor 162 and a memory 164 that contains programming that is configured to carry out the method steps described below, and may be configured to receive inputs and transmit outputs as described below.

While the non-limiting example of the control system 154 has been shown in FIG. 4 as a single block, it will be understood by persons skilled in the art that in practice the control system 154 may be a complex distributed control system having multiple individual controllers connected to one another over a network.

The swing door 102 may have a conventional opening lever (not shown) located inside the passenger compartment for manually opening the door latch 155. This opening lever may trigger a switch connected to the control system 154 such that, when the switch is actuated, the control system 154 powers (i.e. energizes) the clutch unit 136 to disengage the actuator 100 and allow for manual movement of the swing door 102.

The control system 154 can operate in a 'power assist' mode where the control system 154 determines that a user is trying to manually move the swing door 102 when the actuator 100 is in a power open or power close mode. A current sensor 180 (FIG. 4) may be provided for the motor 152 for determining the amount of current drawn by the motor 152. One or more Hall-effect sensors (one is shown at 182) may be provided and positioned to send signals to the control system 154 that are indicative of rotational movement of the motor 152 and indicative of the rotational speed of the motor 152, e.g. based on counting signals from the Hall-effect sensor 182 detecting a target on the motor output shaft. In situations where the sensed motor speed is greater than a threshold speed and where the current sensor registers a significant change in the current draw, the control system 154 may determine that the user is manually moving the door 102 while the motor 152 is also moving the door 102, and that therefore the user wishes to manually move the swing door 102. The control system 154 may then stop the motor 152 and may energize and thus disengage the clutch 136. Conversely, when the control system 154 is in the power open or close mode and the Hall-effect sensors indicate that the motor speed is less than a threshold speed (e.g. zero) and a current spike is registered, the control system 154 may determine that an obstacle is in the way of the door 102, in which case the control system 154 may take any suitable action, such as stopping the motor 152. As an alternative, the control system 154 may detect that the user wants to initiate manual movement of the door 102 if signals from the absolute position sensor 134 indicate movement of the extensible member at a time when the motor 152 is not powered.

FIGS. 6 and 6A-6E show a non-limiting version of a system state diagram and control system logic capable of being used by the control system 154. To assist with the clarity of the drawings, items numbered 1 to 12 in circles in FIGS. 6A-6E show where program flow lines connect in adjacent portions of the state diagram. The control system 154 is operable in a plurality of modes, including a latched mode 200 shown in FIG. 6E. In the latched mode 200, the swing door 102 is in the closed position and the door latch 155 is latched. This can be determined by coupling the ratchet 156 to a switch which signals the control system 154 when the ratchet 156 is in an open position, a closed position or in a partially closed position. In the latched mode 200, the control system 154 waits for a door open signal at step 201. The door open signal can come from sources such as a remote switch such as a key fob or a dashboard mounted push button control in the passenger compartment, which will signal that the vehicle user wishes to initiate a power opening of the swing door 102. The door open signal could come from manual activation of the door latch opening lever 184 (FIG. 3A) which may switch a switch 186 positioned to send signals to the control system 154. The switching of switch 186 may indicate to the control system 154 that the user wishes to initiate a manual opening of the swing door 102. In the case where the control system 154 determines that signals indicate that the user wants a power opening of the door 102, the control system 154 enters a power opening mode 202 (FIG. 6C) where the motor 152 is powered to open the swing door 102. When in the power opening mode 202, the control system 154 continuously tests for the detection of an obstacle at step 204 in the manner discussed above. In the event that an obstacle is detected then at step 206 the powered operation of the actuator 100 stops and/or reverses slightly and the control system 154 waits for a new command. Otherwise the powered opening of the swing door 102 continues until at step 208 the control system 154 determines based on signals from the absolute position sensor 134 that the swing door 102 is open to a desired position.

Figures 6, 6A, 6B, 6C, 6D, 6E:
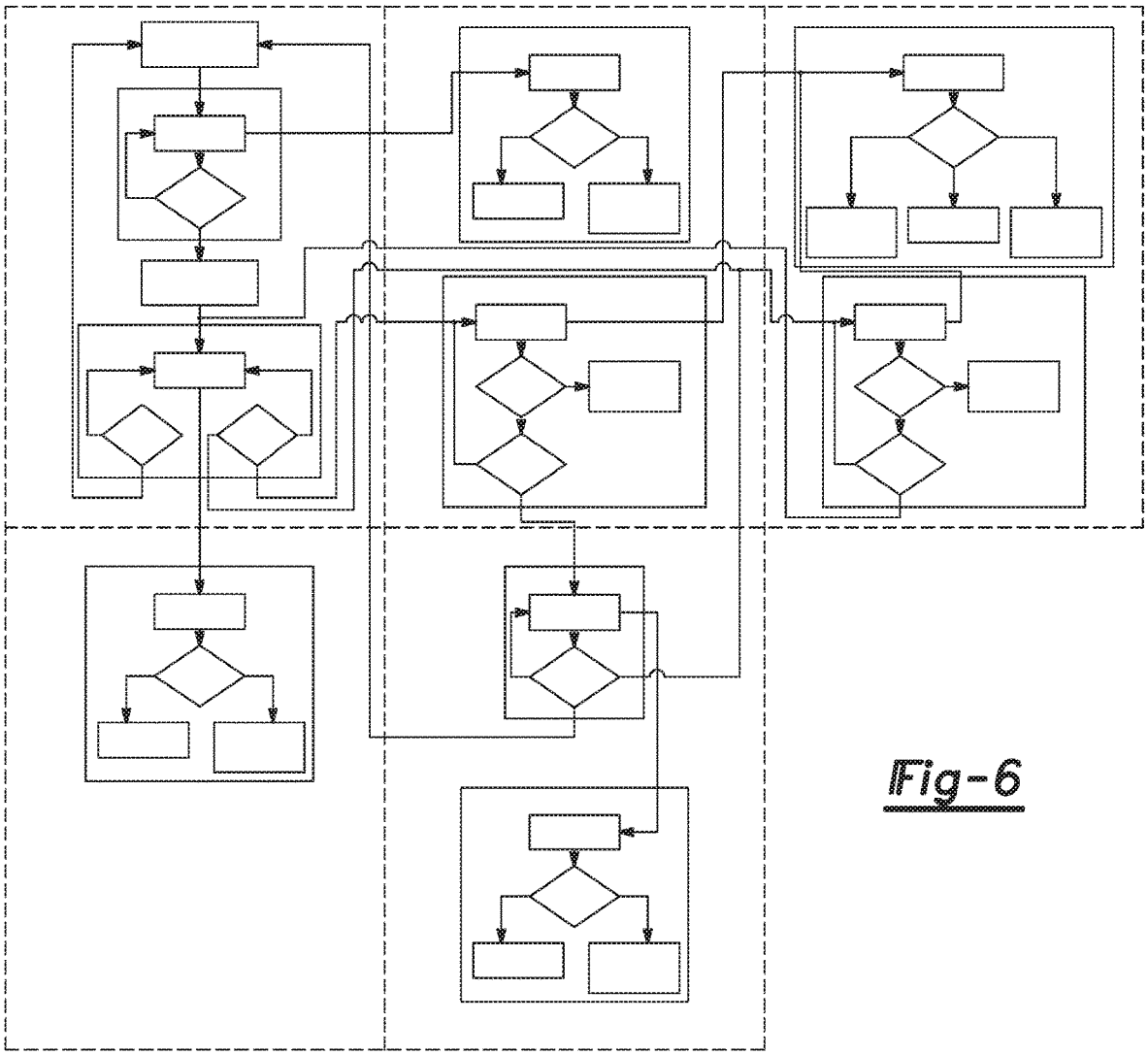
FIGS. 6 and 6A-6E are system state diagrams and logic flowcharts utilized by an electronic control system interfacing with the power swing door actuator of FIG. 4.
Figure 6A:
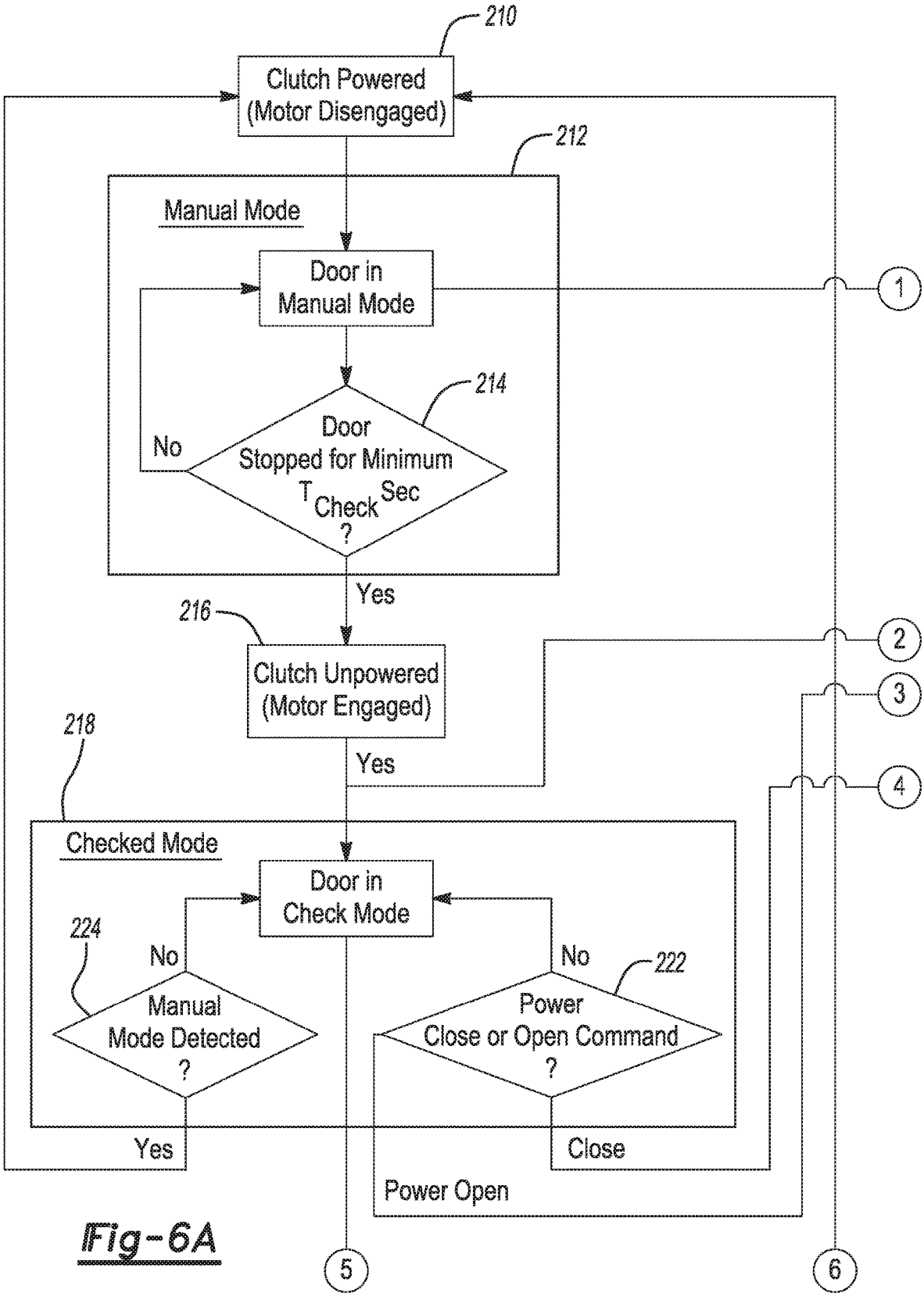
Figure 6B:
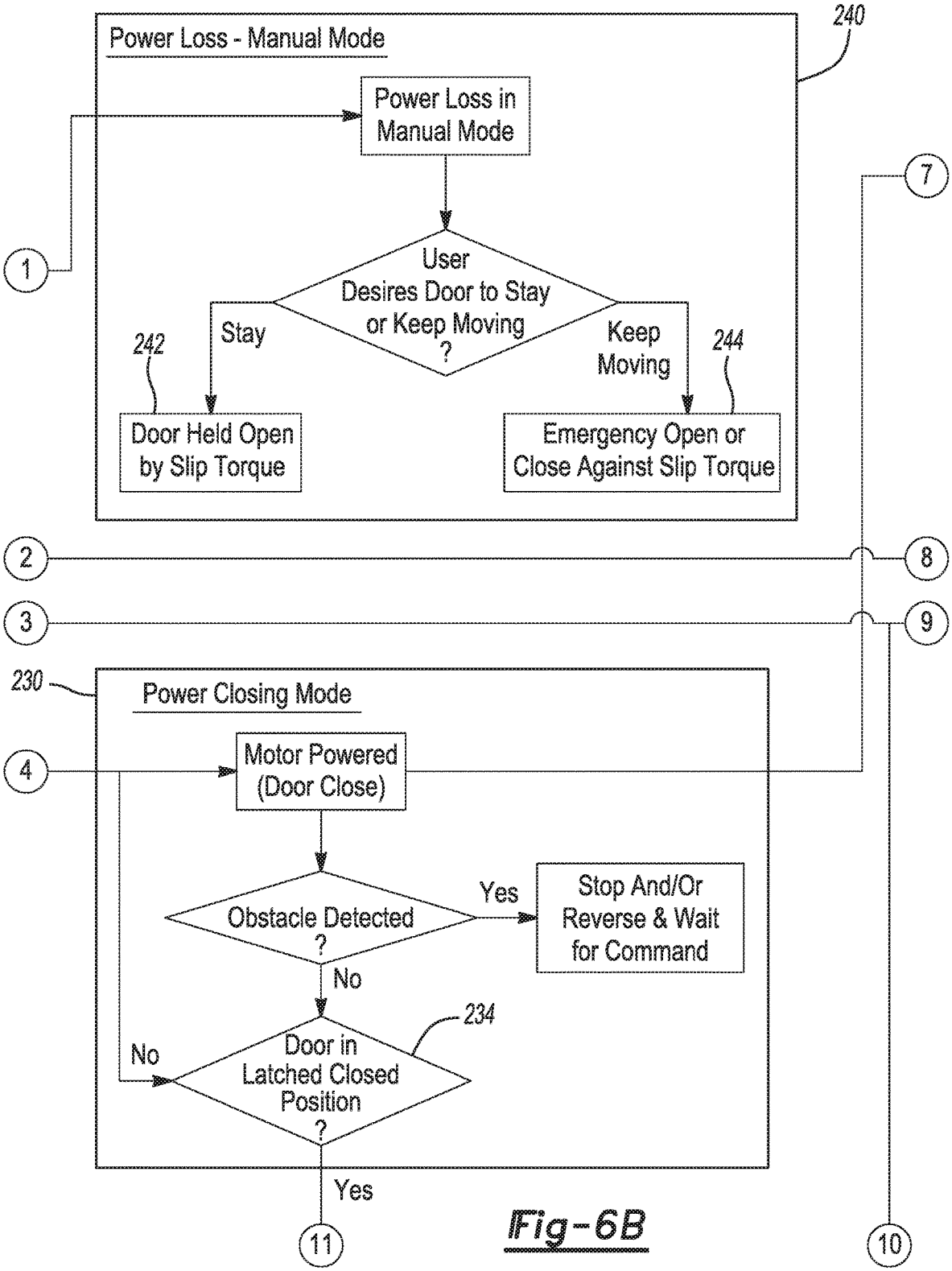
Figure 6C:
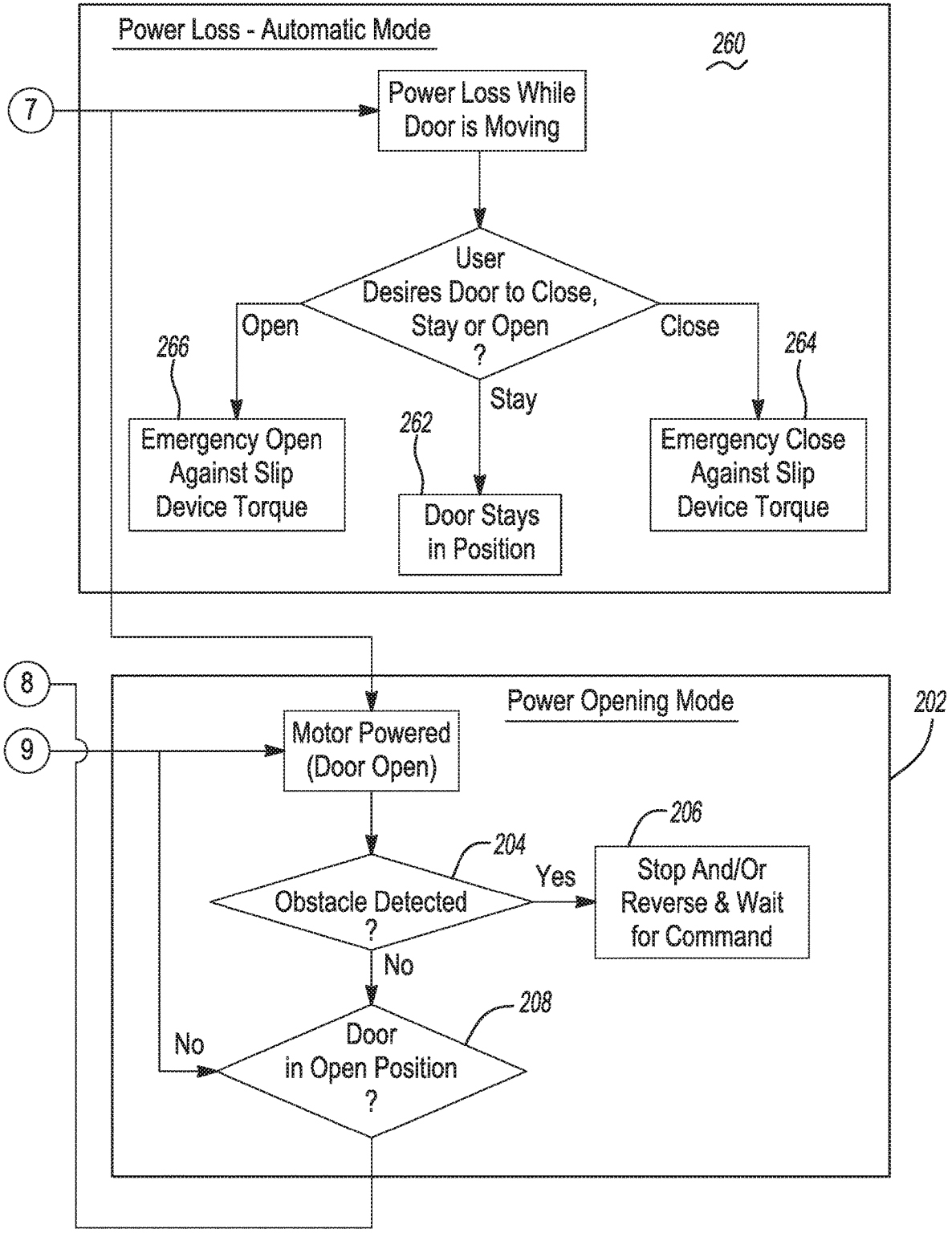
Figure 6D:
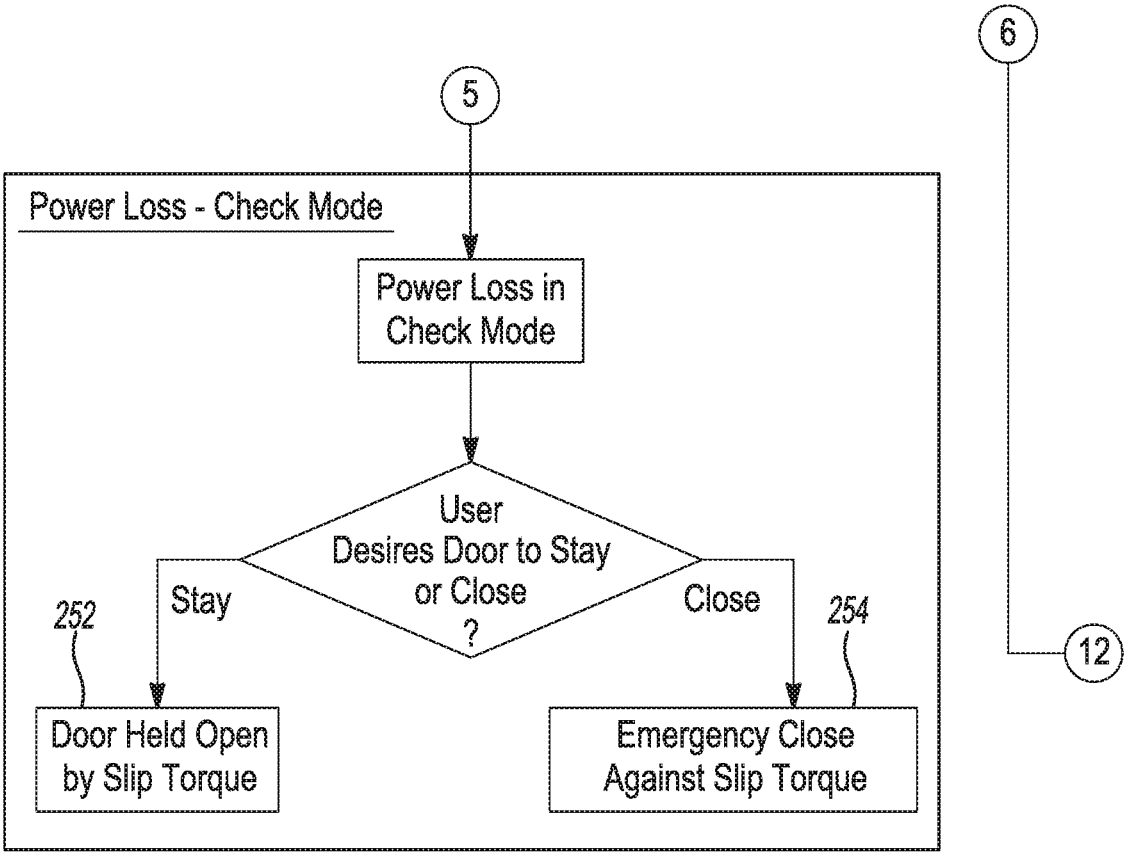
Figure 6E:
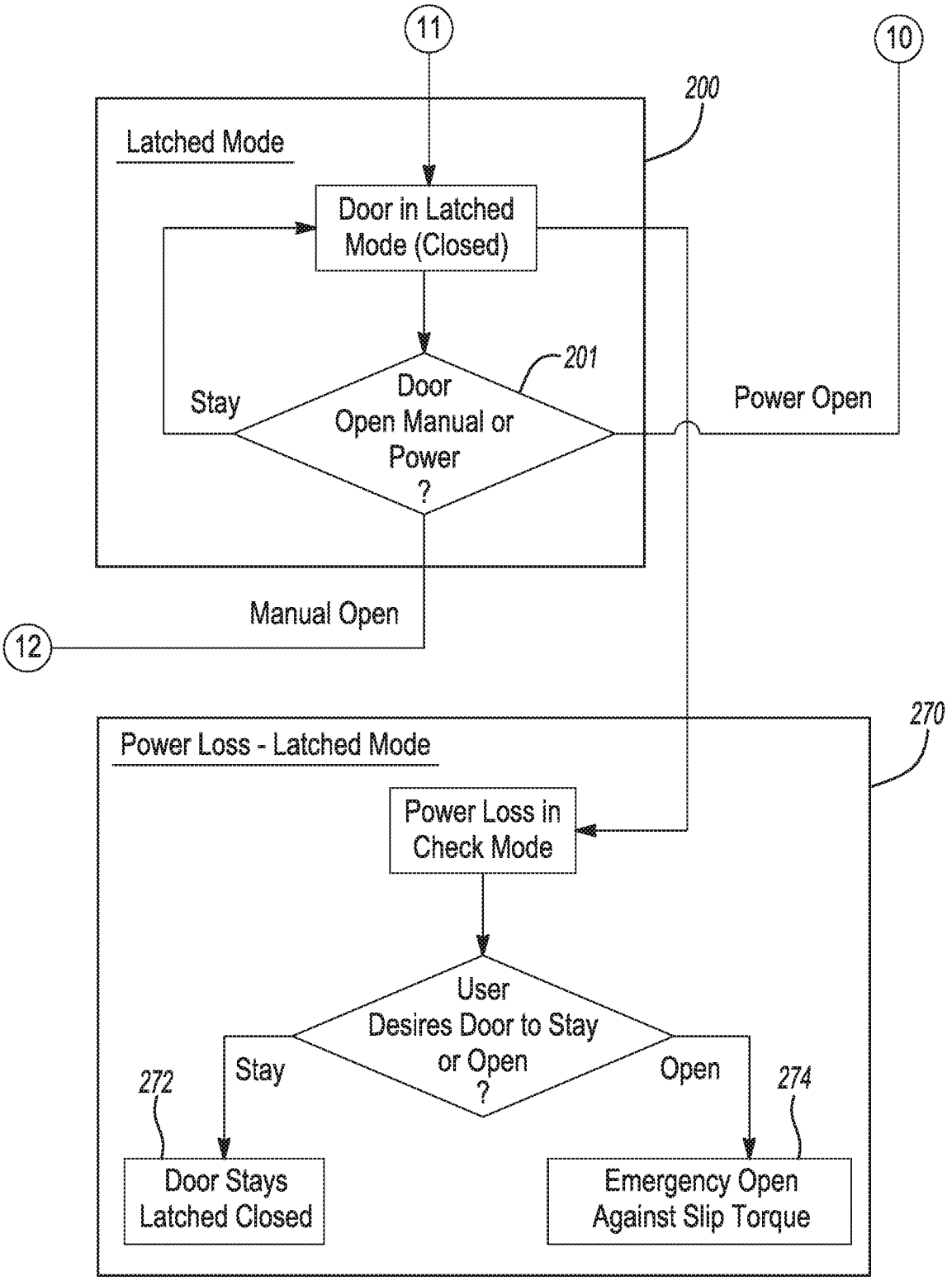

In the case where the control system 154 determines that signals indicate that the user wants a manual opening of the swing door 102, the control system 154 energizes the clutch 136 at step 210 (FIG. 6A) and enters a manual opening mode 212. In the manual opening mode 212 the control system 154 checks to determine at step 214 whether or not the swing door 102 has stopped for at least a selected period of time. If so, then at step 216 the control system 154 deenergizes the clutch 136, thereby coupling the motor 152 to the extensible member 118, and the control system 154 enters a checked mode as shown at 218. At this point the swing door 102 is checked, because of the force required to back-drive the motor 152. The control system 154 waits for further input from the user, either in the form of a power open or power close command at step 222 via the remote key fob or some other way, or by determining that the vehicle user desires to manually move the swing door 102 at step 224 as a result of changing Hall counts instigated by manual movement of the swing door 102. In the case of a power open command the control system 154 re-enters the power opening mode 202 (FIG. 6C). In the case of a power open command the control system 154 re-enters the power opening mode 230 (FIG. 6B), wherein the actuator 100 is powered to close the swing door 102 until the control system 154 determines, e.g. based on signals from the absolute position sensor 134, that the swing door 102 is in the closed and latched position at step 234. In the case where the control system 154 determines that the user desires to manually move the swing door 102, control is passed back to step 210 for manual movement of the swing door 102.

In the event of a power loss the control system 154 (which may be provided with sufficient battery back-up power to run logic and control functions) enters one of several power loss modes. When the control system 154 is in the manual mode 212 and power is lost, the control system 154 enters a manual mode power loss mode 240 (FIG. 6C). In mode 240, because of the lack of power, the clutch 136 is engaged. As a result, if the user wishes to stop further manual movement of the swing door 102, they can do so and the door 102 will remain held (i.e. checked) at its current position as shown at step 242. If the user wishes to continue to move the door 102 from its current position they can do so at step 244 by overcoming the clutch slip torque associated with the clutch 136.

When the control system 154 is in the checked mode 218 and power is lost, the control system 154 enters checked mode power loss mode 250 (FIG. 6D). In this mode, the loss of power means that the clutch 136 is engaged and as a result, the door 102 will remain checked at step 252. If the user wishes to move the door, they can manually move the swing door open or closed at step 254 by overcoming the clutch slip torque associated with the clutch 136.

When the control system 154 is in the power open mode 202 or the power close mode 230 and power is lost, the control system 154 enters a powered movement power loss mode 260 (FIG. 6C). The door 102 will stop at its current position and will be held there (i.e. checked) at step 262 by virtue of the clutch slip torque. If the user desires to open or close the door 102 from the current position, they can manually open or close the door 102 at steps 264 or 266, by overcoming the clutch slip torque.

When the control system 154 is in the latched mode 200 and power is lost, the control system 154 enters latched mode power loss state 270 (FIG. 6E), where the swing door 102 can continue to remain closed at step 272, or if the user wishes, the swing door can be manually opened at step 274 by overcoming the clutch slip torque.

The swing door actuation systems of the present disclosure enable a powered open and powered close of the vehicular swing door 102, where the normally engaged clutch 136 enables the motor 152 and the gear train 137 to drive the lead screw 128 in order to open and close the swing door 102. The swing door actuation system also enables the user to manually open and close the vehicle swing door 102 by powering the clutch 136 to disengage the gear train 137 and the motor 152 in a manual mode wherein only the lead screw 128 is back-driven during manual movement with relatively low manual effort and noise. Disengagement of the clutch 136 eliminates the effort and noise that is associated with back-driving the gear train 137 and the motor 152. As a result, the manual effort to move the swing door 102 may be similar in some embodiments, to a conventional non-powered vehicle door. When the clutch 136 is engaged, an infinite position door check function is provided, via engagement of the lead screw 128 to the gear train 137 (and in particular to the worm 150, which has a thread angle configured to prevent back-driving from the worm gear 138). As a result of the normally-engaged clutch 136, the infinite door check function is available in the event of vehicle power loss thereby precluding an uncontrolled swinging of the door 102 during such a power loss event. However, the user can still manually move the swing door 102 open and closed in a power loss event by overcoming an appropriately selected slip torque of the clutch 136. Additionally, the clutch 136 protects the swing door actuation system from shock and abuse loading.

The swing door actuation systems of the present disclosure provide a means for speed control and obstacle detection. Speed control is attained by the control system 154 monitoring the Hall-effect signals and/or the absolute position sensor signal. Either signal could be eliminated depending on the desired control features and redundancy requirements. The absolute position sensor is however highly desired for providing the position of the door upon power up or in case of power loss.

The swing door actuation systems of the present disclosure also provide acceptable sound levels during power and manual operation. This is attained in power mode through proper alignment of gears, proper support of the lead screw and flexibly coupling the gear train and lead screw. Acceptable sound levels are attained in manual mode by disengaging the gear train 137 and motor 152 for manual operation.

The swing door actuation systems of the present disclosure may be suitable for packaging and mounting to a typical vehicle swing door. The connecting bracket could be in the front (as shown in FIG. 3) of the actuator or in the rear depending on the packaging objectives. The motor 152 may be aligned in a parallel orientation with the housing rather than perpendicular to it.

It will be noted that the lead screw 128 and the nut tube 124 are just one example of an operative connection between the output end 136*b* of the clutch 136 and the extensible actuation member 118. Any other suitable operative connection may be provided between the output end 136*b* of the clutch 136 to the extensible actuation member 118 for converting the rotary motion of the output end 136*b* into extension and retraction of the extensible actuation member 118. Furthermore, the lead screw 128 and nut tube 124 are just one example of a rotary-to-linear conversion mechanism operable to convert rotary motion (i.e. the rotary motion associated with the output end 136*b* of the clutch 126) into substantially linear motion which drives the extension and retraction of the extensible actuation member 118 relative to the housing 116. The actuator 100 need not include lead screw 128 and nut tube 124 to convert the rotary motion at the output end 136*b* of the clutch 136 into linear motion of the extensible actuation member 118. Any other suitable mechanism for carrying out such a conversion may be used. For example, the output end 136*b* of the clutch 136 may connect to a pair of bevel gears to change the axis of the rotary motion by 90 degrees. The second bevel gear may co-rotate with a spur gear, which in turn drives a rack that is connected to the extensible actuation member 118. As a result, the rotation at the output end 136*b* of the clutch 136 is converted into linear movement of the rack and the extensible actuation member 118. While the lead screw 128 and the nut tube 124, and the gears and rack described above generate pure linear motion of the extensible member (relative to the housing 116), it is possible to instead provide a mechanism that results in substantially linear motion, which may include motion along a relatively large diameter arc, for example. Such motion along a large diameter arc could drive an arcuate extensible member to move along an arcuate path during extension and retraction of the extensible actuation member 118 from the housing 116. In such instances, the housing 116 itself may be slightly arcuate. Such motion of an extensible actuation member 118 would still be effective in driving the opening and closing of the door 102.

The power swing door actuator 100 shown and described in relation to FIGS. 3 through 6 of the drawings utilizes a first pivotal connection between the actuator housing 116 and the door-mounted bracket 120 via a first pivot joint 119 and a second pivotal connection between the terminal end of extensible actuation member 118 and the body-mounted hinge bracket 104 via a second pivot joint 121. As seen from FIGS. 3A-3C, the interior space 123 between outer door panel 112 and inner door panel 110 must be sized to accommodate pivotal movement of actuator housing 116 therein. As an alternative, another version of a power swing door actuator is shown and described in reference to FIGS. 7 through 12 and is hereinafter identified by reference numeral 300. Power swing door actuator 300 can be substituted into vehicle 10 for use in place of power actuator 22 to interconnect vehicle door 12 to vehicle body 14, as well as readily substituted for power swing door actuator 100 installed between the door 102 and the vehicle body 106. Thus, the following detailed description of power swing door actuator 300 is intended to be applicable for use and control within the vehicle applications and control logic previously disclosed herein.

Figure 7:
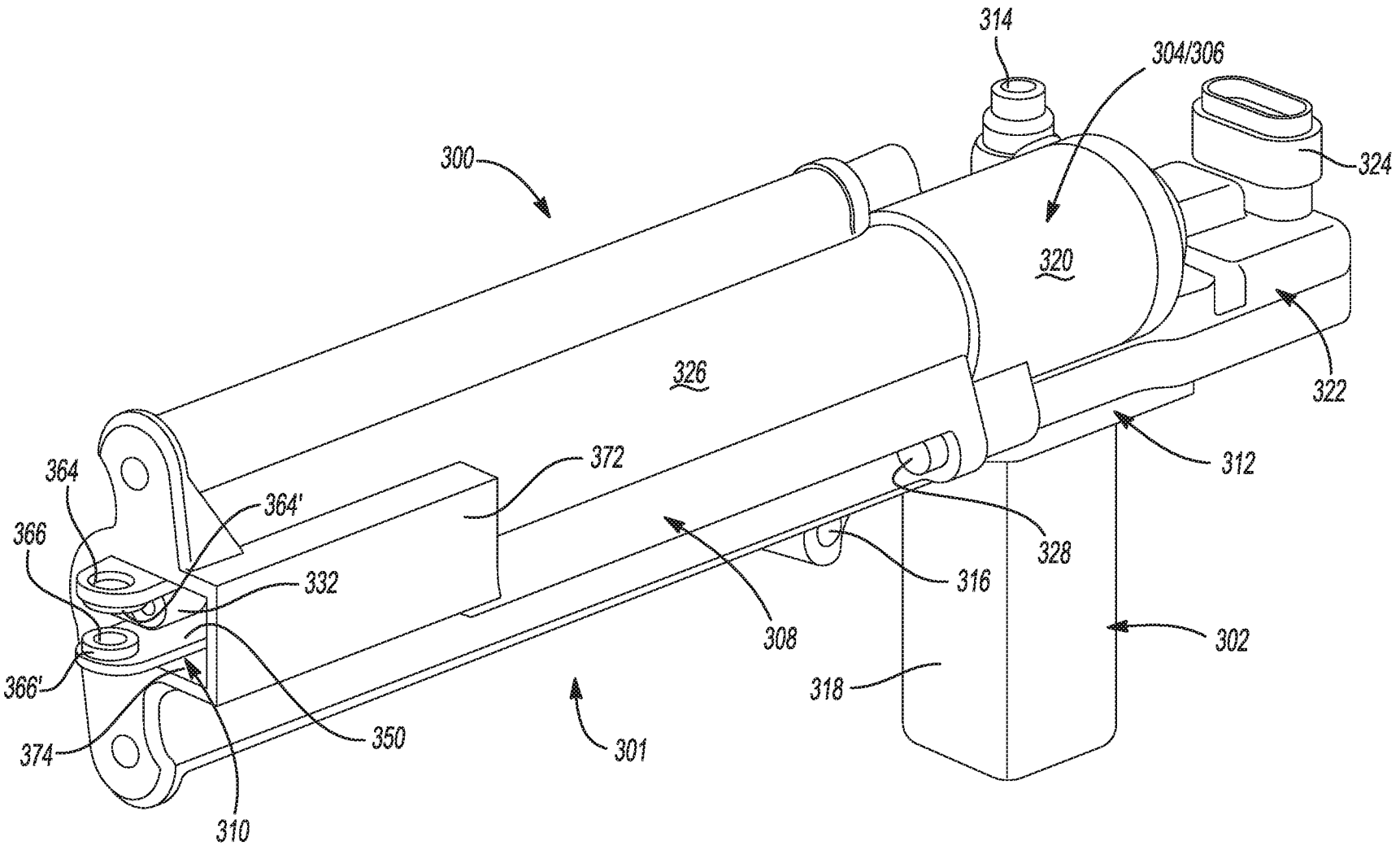
FIG. 7 is an isometric view of another embodiment of a power swing door actuator constructed according to the teachings of the present disclosure.
Figure 8:
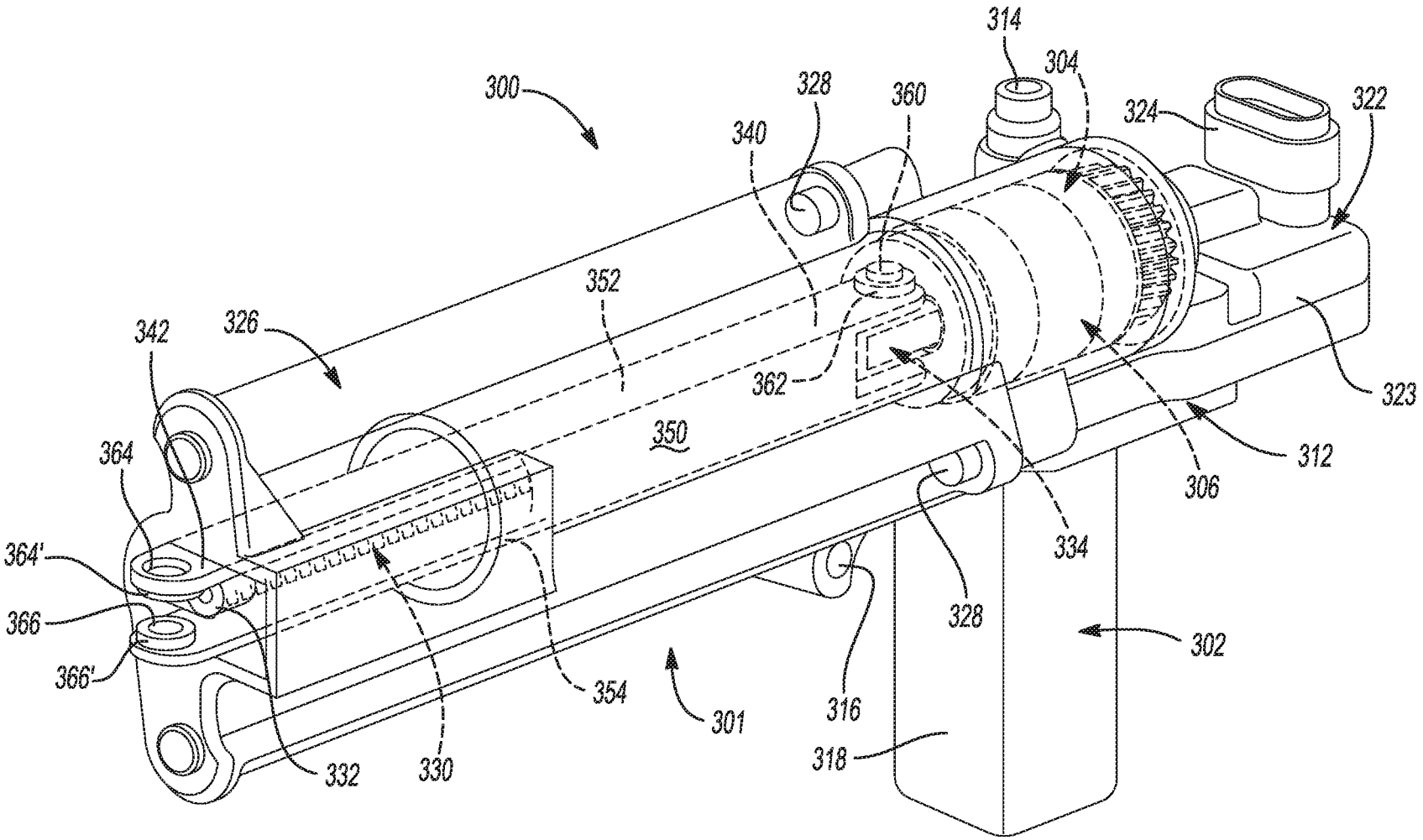
FIG. 8 is a view, similar to FIG. 7, with some components removed or shown transparently to better illustrate certain components of the power swing door actuator.
Figure 9:
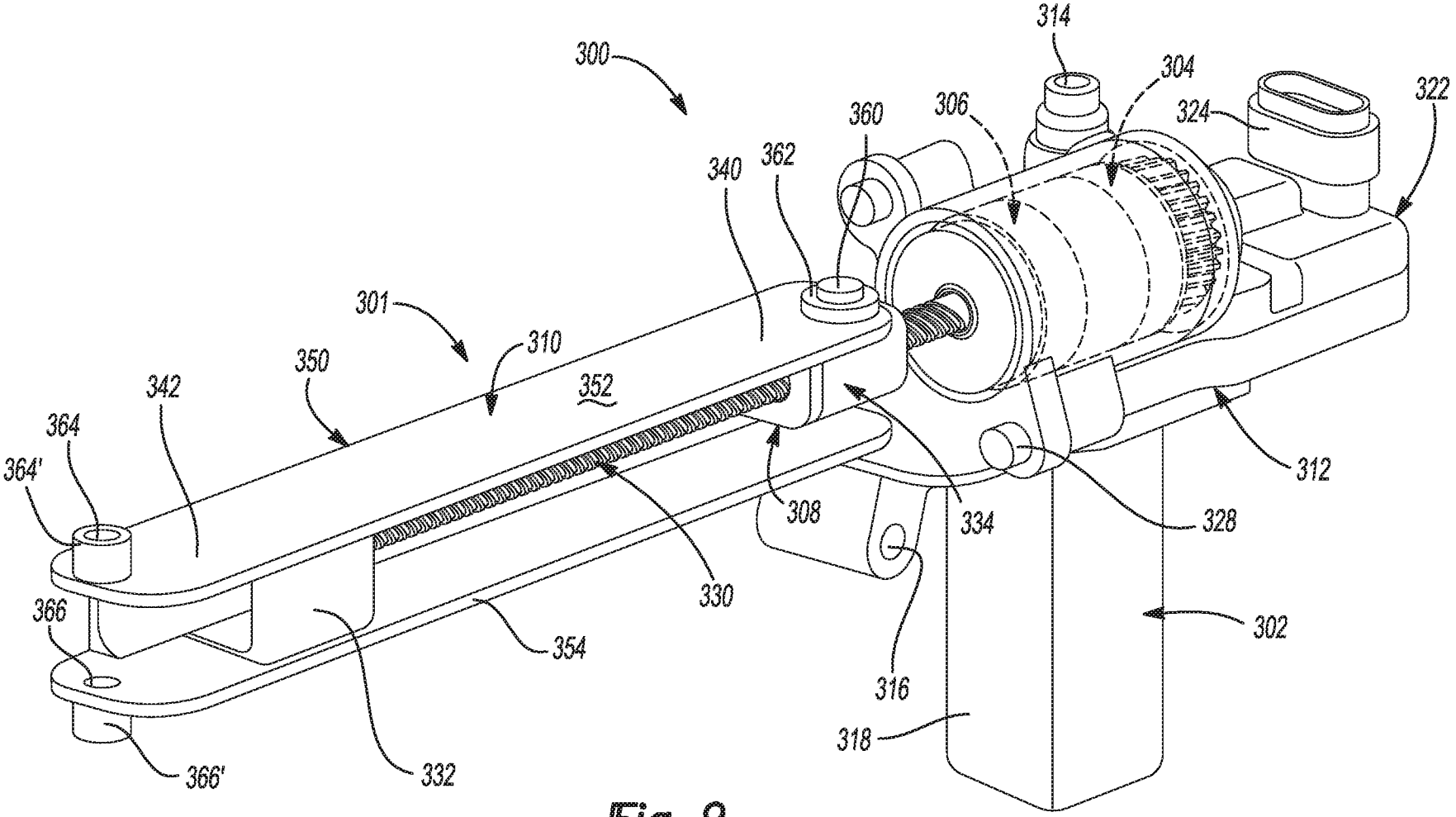
FIG. 9 is another view of the power swing door actuator of FIG. 7.

Referring initially to FIGS. 7-9, power swing door actuator 300 is shown to generally include a power-operated drive mechanism 301 and an articulating pivot linkage mechanism 310. Power-operated drive mechanism 301 is adapted to be secured to the vehicle door and configured to selectively move an extensible actuation member between retracted and extended positions. Linkage mechanism 310 is pivotably connected between the extensible actuation member and the vehicle body to accommodate swing movement of the vehicle door. Power-operated drive mechanism 301 is shown to include, in this non-limiting embodiment, an electric motor 302, a reduction geartrain unit 304, a slip clutch unit 306, and a spindle drive unit 308. Power swing door actuator 300 also includes a mounting unit, such as a mounting bracket 312, having one or more mounting apertures 314, 316 configured to receive fasteners (not shown) for securing mounting bracket 312 to the vehicle door between the inner and outer panels thereof. A motor housing 318 associated with electric motor 302 is secured to mounting bracket 312. Likewise, a clutch housing 320 is secured to mounting bracket 312 and is configured to enclose geartrain unit 304 and clutch unit 306. An integrated controller unit 322 is also provided in associated with actuator 300 and may include a printed circuit board (not shown) and electronic circuitry and components required to control actuation of electric motor 302, all of which are mounted within a controller housing 323. Controller housing 323 is configured to be secured to mounting bracket 312 and includes a plug-in connector 324 to provide electrical power to actuator 300. Finally, an elongated drive housing 326 is shown connected via fasteners 328 to clutch housing 320. While not limited thereto, mounting bracket 312 may be integrated with clutch housing 320 into a rigid mounting component configured to permit attachment thereto of motor housing 318, drive housing 326 and controller unit 322 to provide a compactly packaged actuator arrangement.

Figure 10:
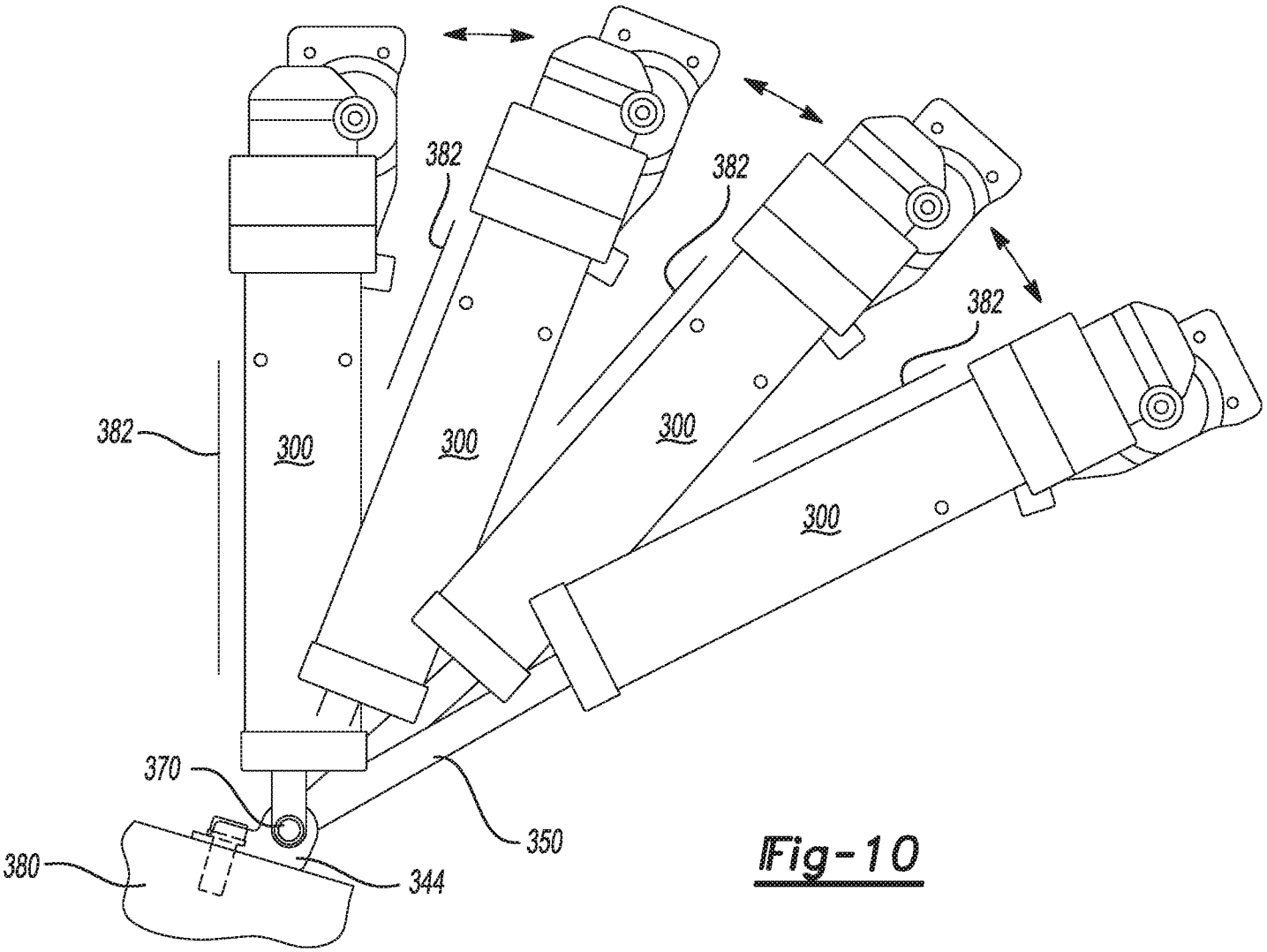
FIG. 10 are composite views of the power swing door actuator of FIG. 7, as installed in the vehicle door and having an articulatable pivot linkage mechanism pivotably coupled to the vehicle body, for showing movement of the door between a fully-closed position, first and second intermediate positions, and a fully-open position.
Figure 11A:
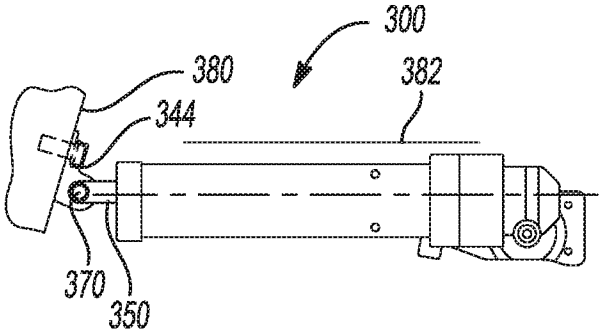
FIGS. 11A-11D further illustrate the positions of the door-mounted power swing door actuator shown in FIG. 10.
Figure 11B:
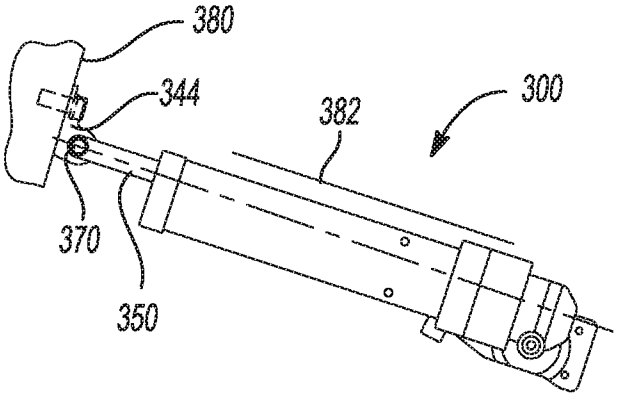
Figure 11C:
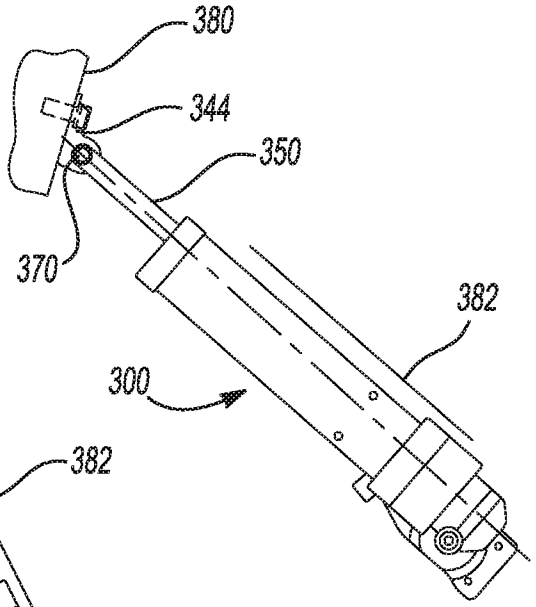
Figure 11D:
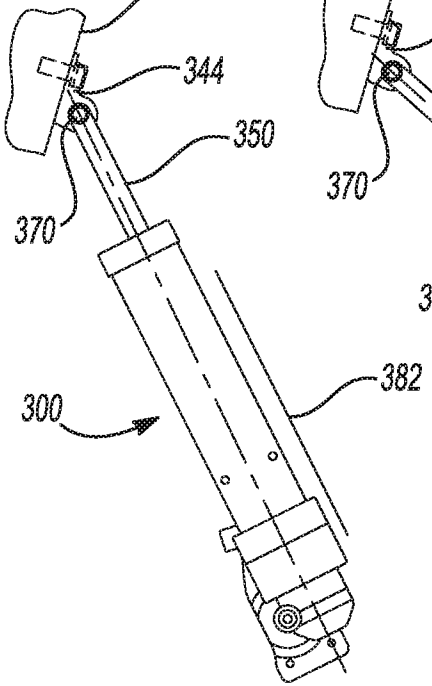

Electric motor 302 includes a rotary output shaft driving an input gear component of geartrain unit 304 which, in turn, drives an output gear component of geartrain unit 304 at a reduced speed and with a multiplied torque. The output gear component of geartrain unit 304 drives an input clutch member of clutch unit 306 which, in turn, drives an output clutch member of clutch unit 306 until a predetermined slip torque is applied therebetween. The output clutch member of clutch unit 306 drives a rotary component of spindle drive unit 308 which, in turn, is converted into linear, non-rotary movement of the extensible actuation member. In the non-limiting arrangement shown, the rotary component of spindle drive unit 308 is an externally-threaded leadscrew 330. A first end of leadscrew 330 is rotatably supported by a first bearing (not shown) within geartrain housing 320 while a second end of leadscrew 330 is rotatably supported in a bushing 332 mounted in pivot linkage mechanism 310. Spindle drive unit 308 also includes an internally-threaded drive nut 334 in threaded engagement with externally-threaded leadscrew 330. Drive nut 334 acts as the non-rotary, linearly moveable, extensible actuation member of power-operated drive mechanism 301. Linkage mechanism 310 is generally configured to have a first link segment 340 pivotably connected to drive nut 334 and a second link segment 342 pivotably connected to a body-mounted bracket 344 (FIG. 10). This incorporation of articulatable pivot linkage mechanism 310 between spindle drive unit 308 and the vehicle body accommodates swinging motion of the vehicle door upon movement between its fully-closed and fully-open positions while permitting direct fixation of power swing door actuator 300 within a smaller internal packaging portion of the vehicle door.

As best seen in FIGS. 8 and 9, pivot linkage mechanism 310 includes a box-shape connector link 350 having a top plate 352 and a bottom plate 354 interconnected by a pair of laterally-spaced side plates 356, 358. Note that side plate 358 is removed in FIG. 9 to better illustrate the threaded engagement of drive nut 334 with leadscrew 330. A pair of pivot posts 360 (only one shown) extend outwardly from opposite surfaces of drive nut 334 and are each retained in one of a corresponding pair of apertured bosses 362 (only one shown) formed respectively in top plate 352 and bottom plate 354. As such, first link segment 340 of connector link 350 is pivotably coupled to drive nut 334. Likewise, a pair of aligned pivot boss apertures 364, 366 formed in plates 352, 354 of connector link 350 are configured to receive a pivot post 370 (FIG. 10) for pivotably coupling second link segment 342 of connector link 350 to body-mounted bracket 344. FIGS. 7 and 8 show boss apertures 364, 366 with their support tube segments 364', 366' facing toward each other between plates 352, 354. In contrast, FIG. 9 shows the tube segments 364", 366" facing away from each other to illustrate an alternative construction. FIG. 7 best illustrates an enlarged section 372 of drive housing 326 formed adjacent to second link segment 342 of connector link 350 and having an enlarged pivot channel 374 provided for accommodating angular and translatory movement of connector link 350 relative to drive housing 326 resulting from swinging movement of the door between its open and closed positions.

FIG. 10 illustrates movement of power swing door actuator 300 relative to vehicle body 380 in response to actuation thereof causing movement of the vehicle door (line 382 indicates the door inner panel) from its fully closed position to its fully open position. The two intermediate open positions are shown for purposes of illustration only to indicate available checked positions of the vehicle door. To this end, drive nut 334 and connector link 350 are positioned in a fully retracted position relative to leadscrew 330 within drive housing 326 when the vehicle door is closed. In contrast, drive nut 334 and connector link 350 are positioned in a fully extended position relative to leadscrew 330 and drive housing 326 when the vehicle door is fully opened. The pivotable connection between first link segment 340 of connector link 350 and drive nut 334 also prevents rotation of drive nut 334 relative to drive housing 326 in response to rotation of leadscrew 330. Since second link segment 342 connector link 350 is also pivotably secured to vehicle body 380 via pivot post 370 on mounting bracket 344, actuation of electric motor 302 converts rotation of leadscrew 330 into linear translation of leadscrew 330 relative to drive nut 334. Such translation of leadscrew 330 results in corresponding translational movement of actuator 300. Since actuator 300 is directly secured to the door 382, rotation of leadscrew 330 in a first direction causes an opening door function while rotation of leadscrew 330 in a second direction causes a closing door function. Similar illustrations of power swing door actuator 300 in these various positions are shown in FIGS. 11A-11D as well as in FIGS. 12A-12D. FIGS. 11A-11D illustrate movement of a center line of connector link 350 relative to actuator housing 326 resulting upon movement of the door between its fully-closed and fully-open positions.

Power swing door actuator 300 provides both push and pull forces to operate the power door system, particularly for passenger-type doors on motor vehicles. While power actuator 300 provides an electrical "checking" function, it is contemplated that a mechanical checklink systems could easily be integrated with power actuator 300. Additionally, articulating pivot linkage mechanism 310, when combined with a mechanical checking mechanism, allows the power-operated swing door to have the same translating path as a non-powered checklink arrangement. Articulating pivot linkage mechanism 310 allows the checklink path to follow the same path as conventional checklink configurations, rather than a linear path. Integrating a checklink mechanism into power swing door actuator 300 would also permit elimination of a separate door check feature. While power door actuator 300 has been described having power-operated drive mechanism 301 configured to convert rotary motion of electric motor 302 into linear, non-rotary motion of pivot linkage mechanism 310, those skilled in the art will appreciate that alternative linear actuators could be used such as, for example, an electromagnetic solenoid-type linear actuator. Additionally, the arrangement of power door actuator 300 could be reversed with it secured to the vehicle body such that linkage mechanism 310 is pivotably connected to the vehicle door, assuming adequate packaging space is available.

Figure 12A:
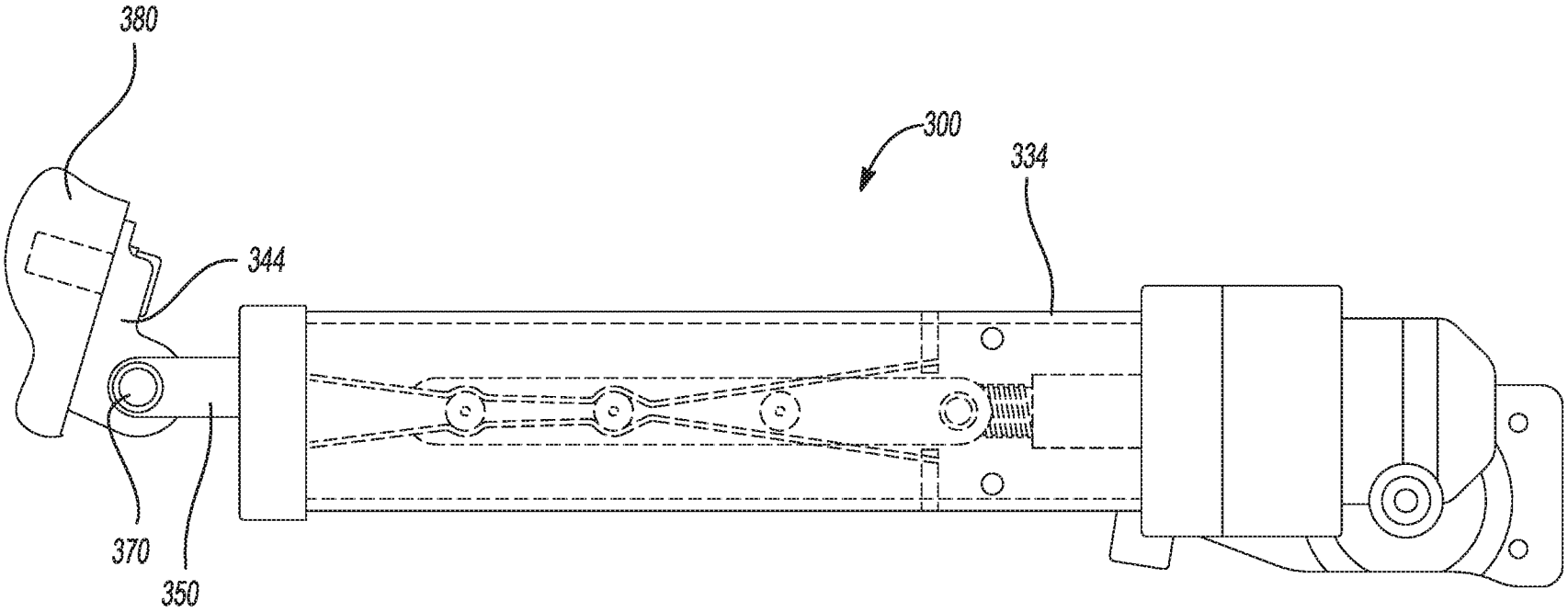
FIGS. 12A-12D also further illustrate the positions of the door-mounted power swing door actuator of FIG. 10.
Figure 12B:
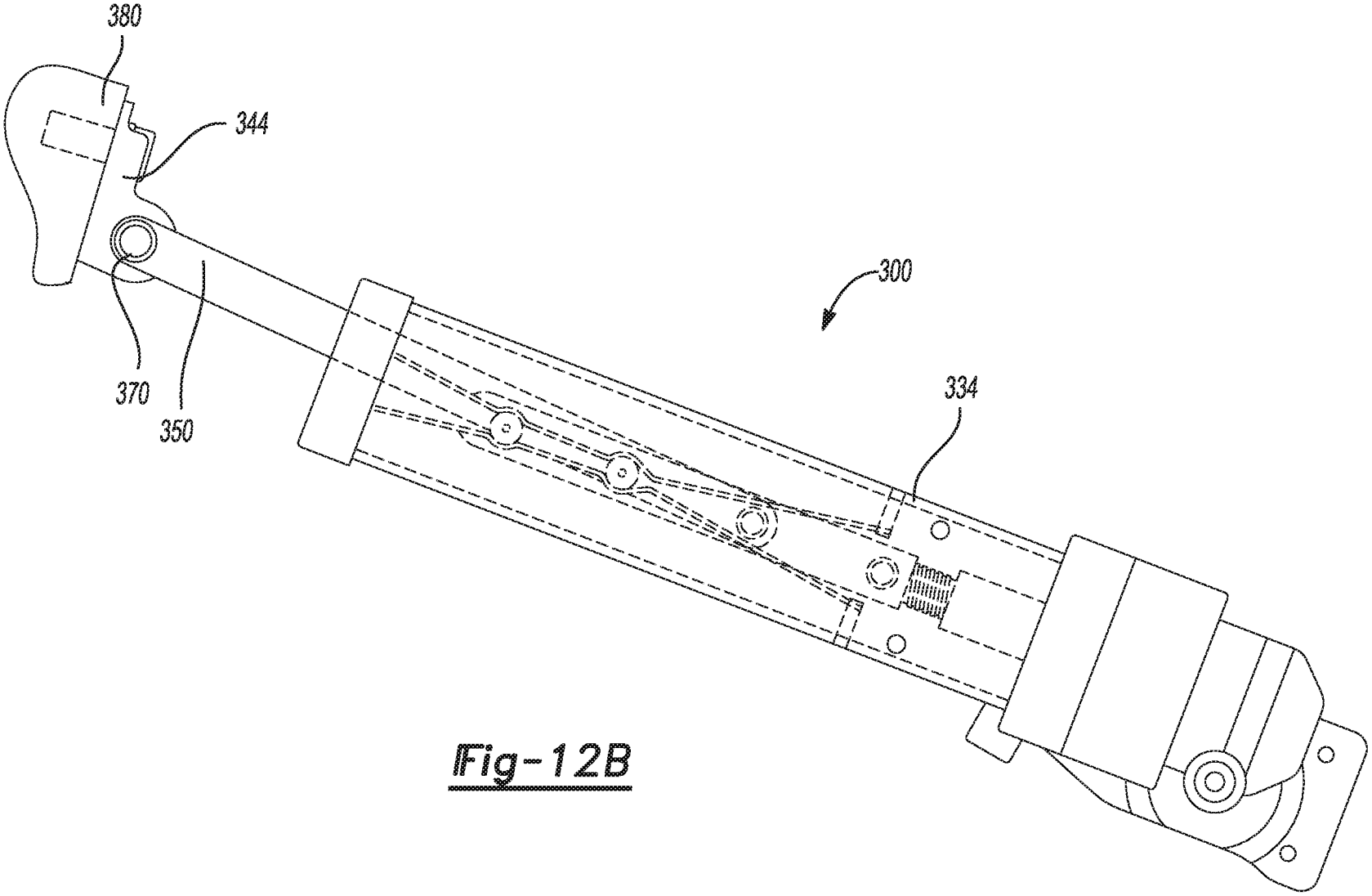
Figure 12C:
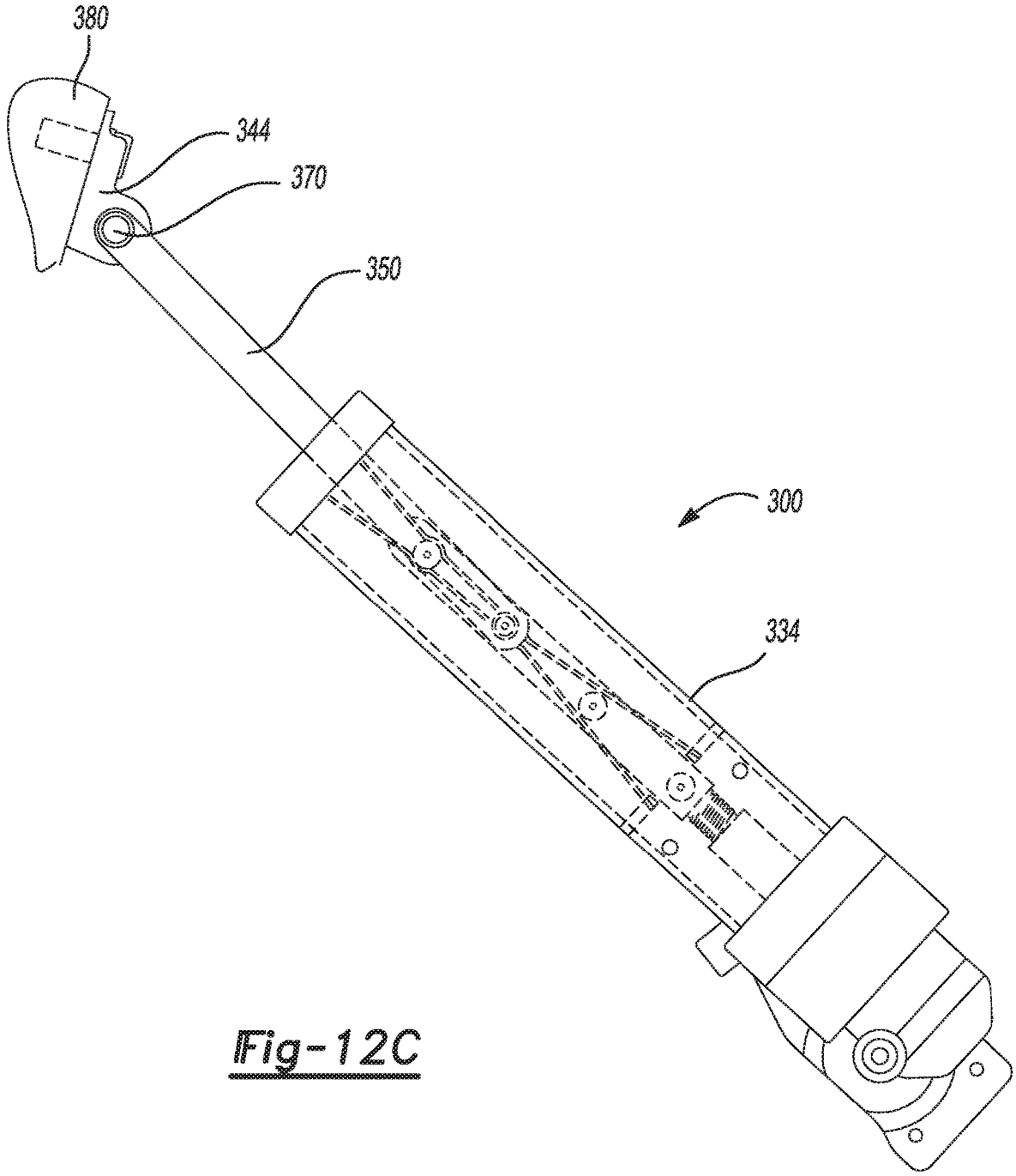
Figure 12D:
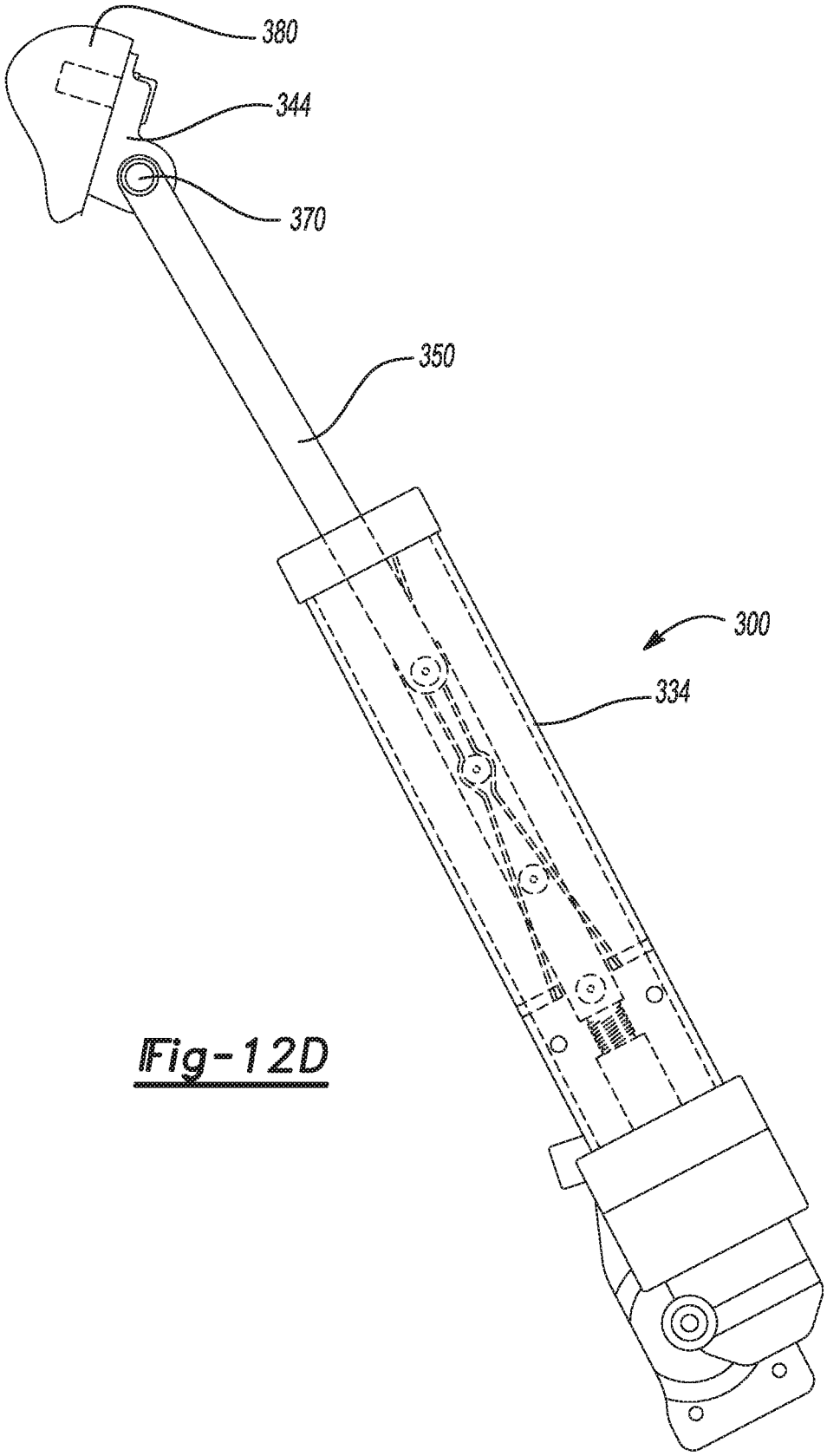
Figure 13:
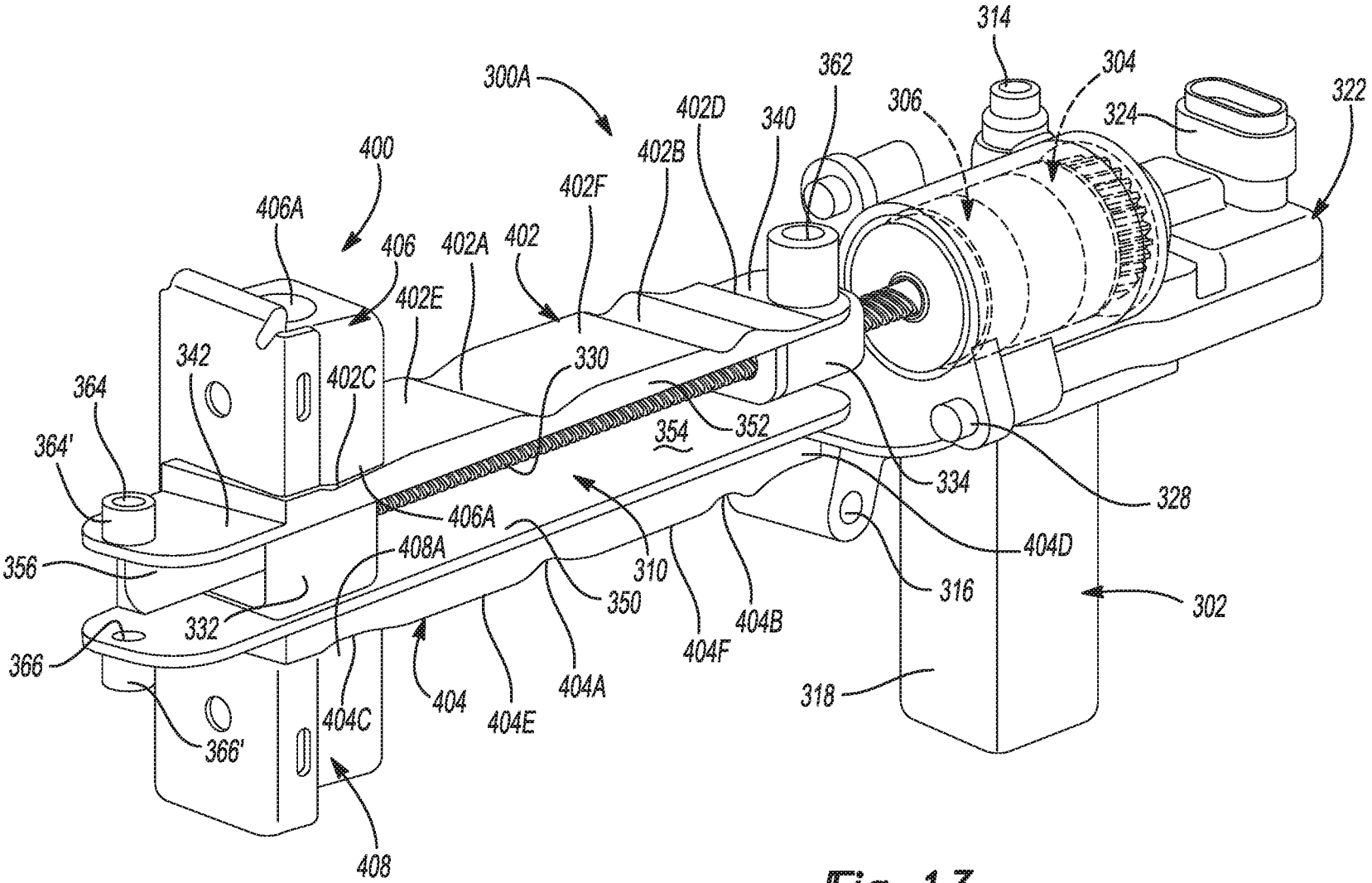
FIG. 13 is an isometric view, similar to FIG. 9, but now showing another embodiment of a power swing door actuator constructed according to the present disclosure to include an integrated door check mechanism.

Referring now to FIG. 13, a power swing door actuator 300A, which is generally similar to power swing door actuator 300 shown in FIG. 9, is shown to further include an integrated door check mechanism 400 configured to provide a means for mechanically holding the vehicle door in one or more intermediate open positions defined between the fully-open position and the closed position. Specifically, in accordance with a non-limiting example, door check mechanism 400 is configured to mechanically hold the vehicle door in the intermediate Door Check Positions 1 and 2 as well as the Full-Open door position identified in FIGS. 10-12.

Door check mechanism 400 is shown, in the non-limiting embodiment, to include a pair of contoured check pads 402, 404 respectively formed on or mounted to outer surfaces of top plate 352 and bottom plate 354 of connector link 350. Each check pad 402, 404 is configured to define a first detent 402A, 404A and a second detent 402B, 404B. In addition to these detents, each check pad 402, 404 is configured to include a closed seat 402C, 404C and an open seat 402D, 404D. A pair of check retainers 406, 408 are configured to be fixedly secured to the vehicle door and each has a contoured retention feature, hereinafter referred to as check lug 406A, 408A, configured to engage one of the detents and seats formed in the corresponding detent pads 402, 404 so as to define the plurality of mechanically-held door positions. Specifically, FIG. 13 illustrates check lugs 406A, 408A biased into engagement with closed seats 402C, 404C when the vehicle door is closed (similar to FIG. 11A). Upon actuation of power swing door actuator 300A, the actuator housing moves relative to the body-mounted connector link 350 (due to axial translation of leadscrew 330) relative to drive nut 334. Upon the vehicle door moving into a first intermediate position (similar to Position 1 of FIG. 11B), check lugs 406A, 408A are released from closed seats 402C, 404C and ride over cam surfaces 402E, 404E until they snap into engagement with first detents 402A, 404A. Continued opening movement of the vehicle door from the first intermediate position into a second intermediate position (similar to Position 2 of FIG. 11C) results in check lugs 406A, 408A being released from first detents 402A, 404A and riding over cam surfaces 402F, 404F until they snap into engagement with second detents 402B, 404B. Eventually, the vehicle door is held in its fully open position (FIG. 11D) by check lugs 406A, 408A engaging open seats 402D, 404D.

Check pads 402, 404 can be preformed and subsequently attached to connector link 350 or, in the alternative, they can be formed on top and bottom plates 352, 354 via an over-molding process. At least one of check pads 402, 406 and check retainers 406, 408 can be made of a resilient material to allow camming movement during swinging movement of the vehicle door. While not specifically shown, a spring-loaded retention member, such as a ball bearing, can be installed in apertures formed in check retainers 406, 408 and extend through check lugs 406A, 408A and provide the biasing function required to mechanically hold the vehicle door in each available position, while permitting such biasing to be overcome via actuation of electric motor 302 and/or mechanically via manual door movement. The actual number of detents and the specific configuration of check pads 402, 404 are not limited to that shown. As such, the shape and path of the detent pads can be optimized for each particular application (i.e. linear, spline, etc.). This allows power swing door actuator 300A to be used on many different vehicle door systems with only minimal changes while also permitting the conventional mechanical check mechanism associated with the hinged connections to be eliminated. While two identical pads are shown, it is contemplated that only one pad can be used or two pads having differing profiles to provide a larger number of detent door check positions.

Figure 14:
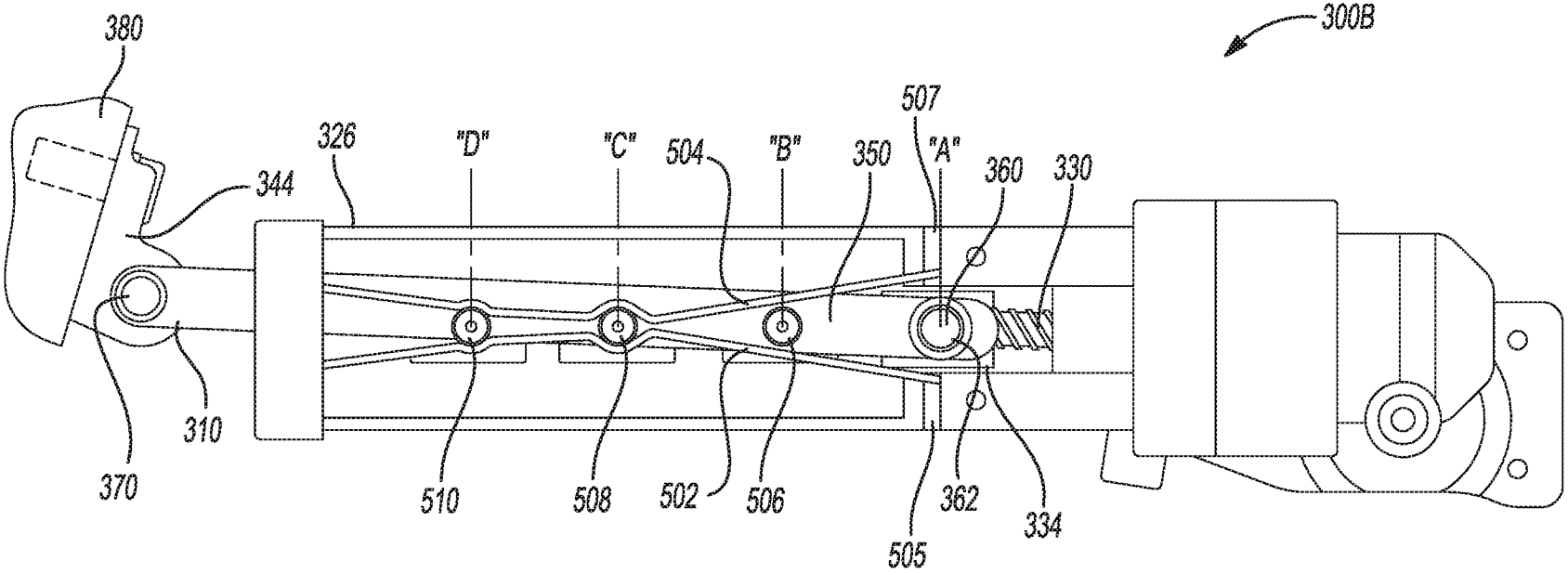
FIG. 14 is a view, similar to FIG. 12, but now showing another embodiment of a power swing door actuator constructed according to the present disclosure to include an alternative version of an integrated door check mechanism.

Referring now to FIG. 14, an alternative configuration for an integrated door check mechanism 500 is shown in association with a power swing door actuator 300B that is generally configured as another modified version of power swing door actuator 300 previously described. In this arrangement, the enlarged boss 362 extending from top plate 352 of connector link 350 and within which pivot post 360 of drive nut 334 is retained is associated with door check mechanism 500. Specifically, boss 362 is disposed between a pair of elongated leaf springs 502, 504 which are each fixed to opposite inside surfaces of actuator drive housing 326. Pins 505, 507 illustrate means for securing first ends of leaf springs 502, 504 to drive housing 326. While not shown, it is recognized that similar pins could be used for securing the second ends of leaf springs 502, 504 in a similar fashion to drive housing 326. Line "A" indicates the position of drive nut 334 relative to drive housing 326 when the vehicle door is in its fully closed position (FIG. 12A). In this position of drive nut 334, boss 362 is located in an area between the first ends of leaf springs 502, 504. Upon movement of the vehicle door from its fully closed position into its first intermediate door check position (FIG. 12B), drive nut 334 and raised boss 362 move to a position relative to drive housing 326 identified by line "B". In this position, raised boss 362 is retained in a first detent seat 506 defined between leaf spring 502, 504. The biasing applied by leaf springs 502, 504 on raised boss 362 in first detent seat 506 is sufficient to mechanically hold the vehicle door in the first intermediate position.

Upon continued movement of the vehicle door in its opening direction, it will be located and held in a second intermediate door check position (FIG. 12C) since drive nut 334 and raised boss 362 are shown by position line "C" relative to drive housing 326. In this position, boss 362 on drive nut 334 is retained in a second detent seat 508 defined between leaf springs 502, 504. The biasing applied by leaf springs 502, 504 on raised boss 362 within second detent seat 508 is sufficient to mechanically hold the vehicle door in the second intermediate door check position. Finally, line "D" illustrates the position of drive nut 334 and raised boss 362 when the vehicle door is located in its fully open position (FIG. 12D). A third detent seat 510, formed between leaf springs 502, 504, is operable to hold boss 362 in this position. While leaf springs 502, 504 are only shown to extend above top plate 352 of connector link 350, a similar door check mechanism can be provided below bottom plate 354, or between top plate 352 and bottom plate 354. For example, while three detent seats 506, 508, 510 are shown in association with leaf springs 502, 504 located above top plate 352, another pair of leaf springs located below bottom plate 354 could provide one or more additional detent seats offset from detent seats 506, 508, 510. The concept simply requires that the position of the drive nut 334 and/or a portion of connector link 350 (detent post extending therefrom) relative to drive housing 326 be used to provide a series of distinct detent or retention positions capable of mechanically holding the vehicle door in an open position. Obviously, any number of additional detent seats can be formed in leaf springs 502, 504 in additional to shown detent seats 506, 508, 510 to provide a corresponding number of mechanical door check positions.

Figure 15:
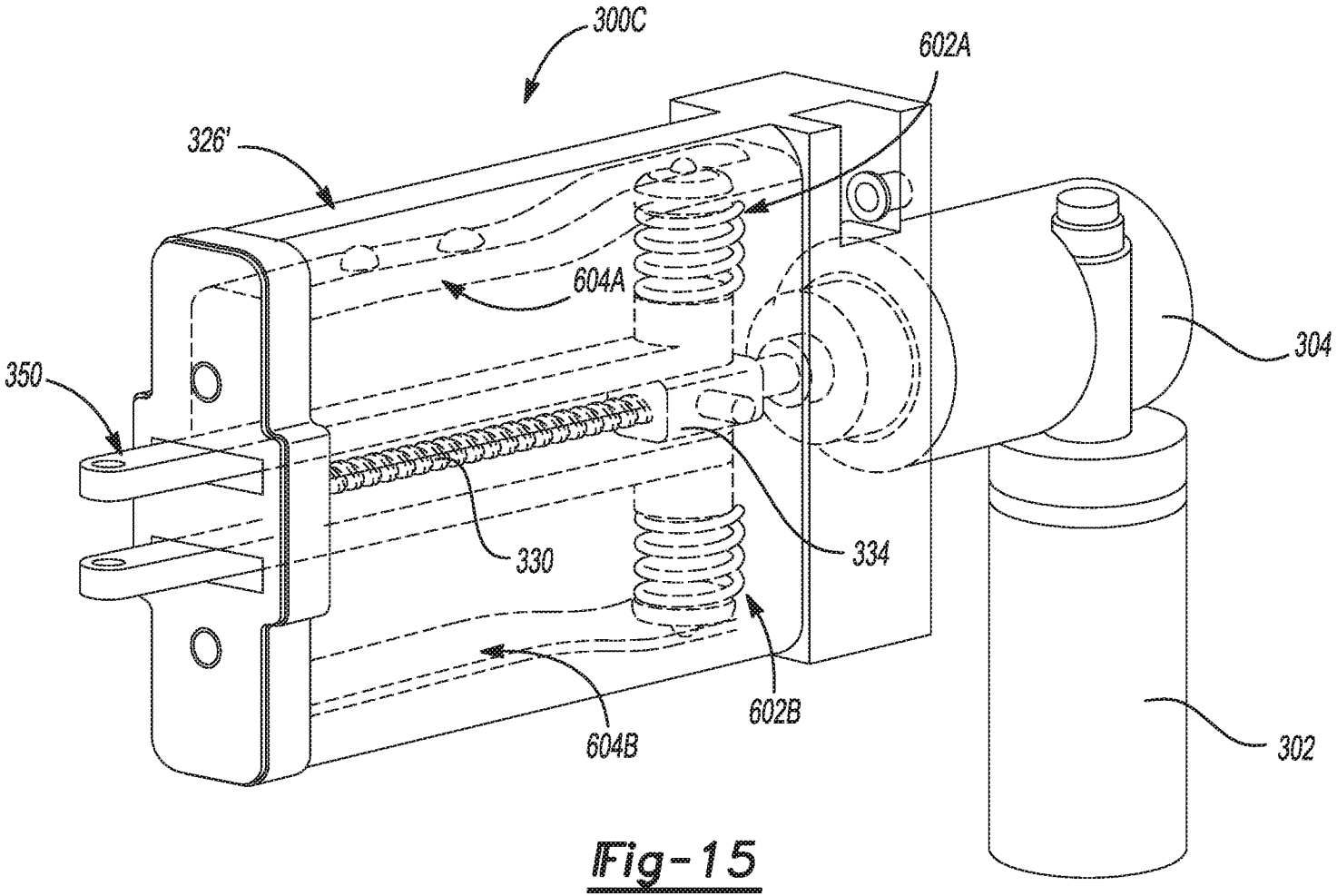
FIG. 15 is an isometric view, again similar generally to FIG. 9, but now showing yet another embodiment of a power swing door actuator constructed according to the present disclosure to include an alternative version of an integrated door check mechanism.
Figure 16:
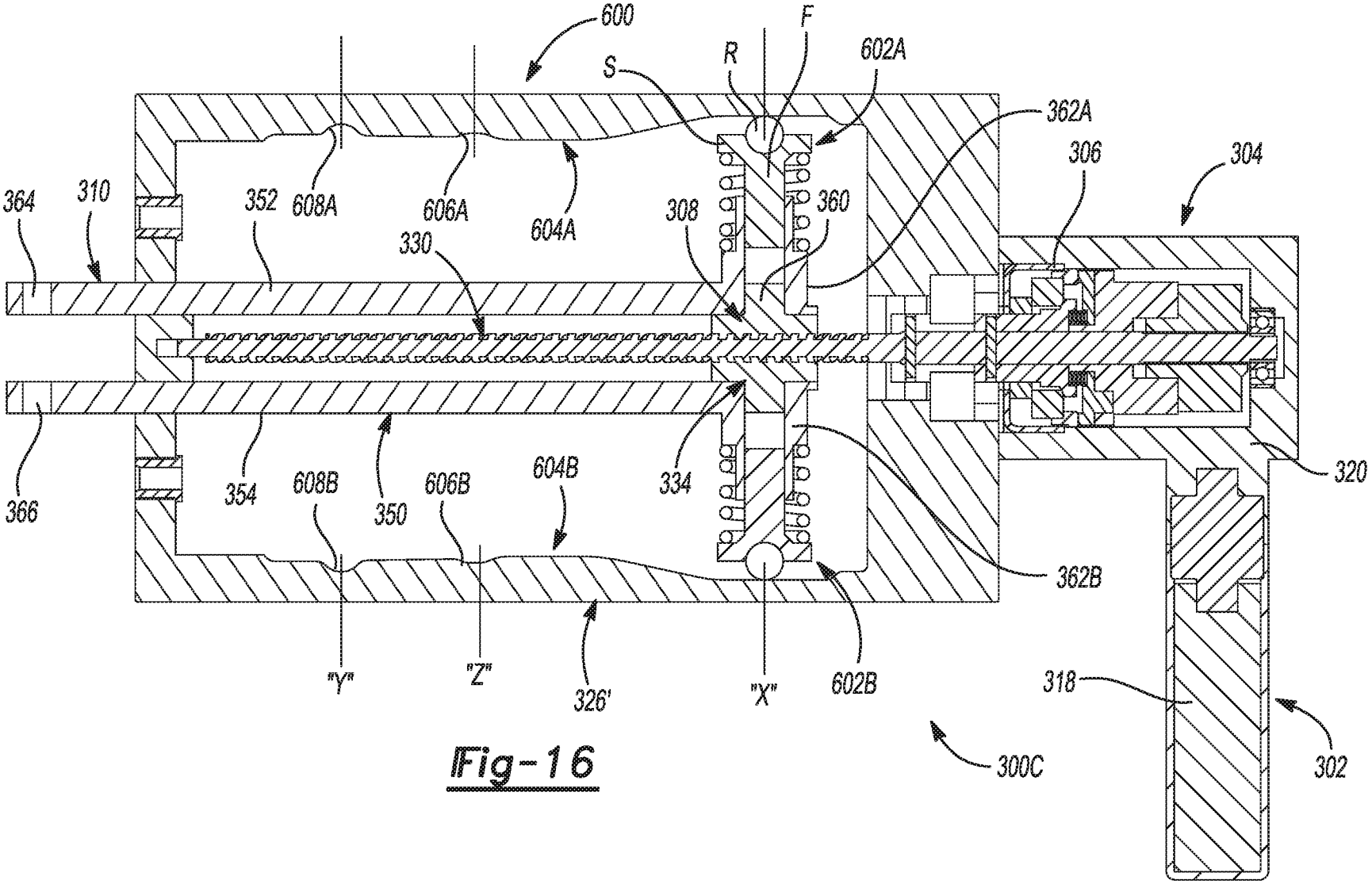
FIG. 16 is a sectional view of the power swing door actuator system shown in FIG. 15.

Referring now to FIGS. 15 and 16, another alternative non-limiting configuration for an integrated door check mechanism 600 is shown in association with a power swing door actuator 300C that is generally another modified version of power swing door actuator 300 previously described. In general, integrated door check mechanism 600 is configured to provide a pair of spring-loaded detent followers 602A, 602B. As before, power swing door actuator 300C generally includes electric motor 302, reduction geartrain 304, slip clutch unit 306, spindle drive unit 308 and pivot linkage mechanism 310. As understood, pivot linkage mechanism 310 is pivotably connected between drive nut 334 of spindle drive unit 308 and body-mounted bracket 344 (FIG. 10) to accommodate swinging motion of the vehicle door upon movement between its fully-closed and fully-opened positions.

The pair of oppositely-extending pivot posts 360 formed on, or fixed to, drive nut 334 are retained in upstanding tubular bosses 362A, 362B respectively formed in top plate 352 and bottom plate 354. A pair of aligned apertures 364, 366 formed in top and bottom plates 352, 354 of connector link 350 are again configured to receive pivot post 370 for pivotably connecting the second end of link 350 to body-mounted bracket 344.

Drive housing 326' is shown to include a pair of elongated checklink guide channels 604A, 604B. Each guide channel 604A, 604B is contoured, in this non-limiting example, to define a fully-closed door detent (Position "X"), an intermediate door check detent (Position "Y"), and a fully-open door detent (Position "Z"). FIGS. 15 and 16 illustrate each of spring-loaded detent followers 602A, 602B located and retained in the fully-closed detent section of corresponding guide channels 604A, 604B when the vehicle door is closed. Each detent follower 602A, 602B includes a detent spring "S" surrounding a corresponding one of tubular bosses 362 formed in plates 352, 354, a follower piston "F" partially retained in bosses 362 and engaged by detent spring S, and a roller "R" retained in a roller seat formed in follower piston F. The radial and lateral contour of guide channels 604A, 604B are varied to apply a compressive preload on spring-loaded detent followers 602A, 602B as connector link 350 moves relative to drive housing 326' in response to swinging movement of the vehicle door from its fully-closed position toward its fully-open position. In particular, an increasing compressive load is exerted on rollers R upon movement of drive nut 334 and connector link 350 out of fully-closed section of guide channels 604A, 604B and toward the fully-open door detent position "Z". Note that roller retainer or detent seats 606A, 606B are formed in guide channels 604A, 604B to hold rollers R in the intermediate door check position "Y" while roller retainer seats 608A, 608B are also formed in guide channels 604A, 604B to hold roller R in the fully-open door check position "Z". Obviously, any number of distinct detent seats can be formed in guide channels 604A, 604B to accommodate a desired plurality of distinct door check positions. Guide channels 604A, 604B can be formed integrally into upper and lower surfaces of actuator drive housing 326' or, in the alternative, can be formed as contoured check pads mounted inside housing 326'. The second option allows a common housing 326' to be installed with alternative versions of check pads configured to provide differing numbers of check seats. Thus, integration of the door check detents into the actuator housing provides multiple manufacturing possibilities. The shape and path of the door check detents can be varied (linear or spline etc.).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power swing door actuator for a vehicle door that is moveable relative to a vehicle body between a closed position and a fully-open position, the power swing door actuator comprising:

a housing mounted to the vehicle door;

a spindle drive mechanism including a leadscrew rotatably supported by the housing and a drive nut in threaded engagement with the leadscrew such that rotation of the leadscrew causes translational movement of the drive nut relative to the leadscrew;

an electric motor supported by the housing and configured to rotatably drive the leadscrew;

an elongated connector link having a first link segment pivotably connected to the drive nut and a second link segment pivotably connected to the vehicle body, wherein the drive nut includes an outwardly extending pivot post that is retained in a pivot aperture formed in the first link segment; and a door check mechanism operably disposed between the connector link and one of the housing and the vehicle door and configured to apply a biasing load on the connector link for mechanically holding the vehicle door in at least one intermediate open position in addition to the fully-open position, the door check mechansim including a check pad and a detent retainer, the check pad being formed on the connector link and defining at least one detent, the detent retainer being carried by the vehicle and configured to move along the check pad and be retained in the at least one detent by the biasing load established between the check pad and the detent retainer when the vehicle door is located in the at least one intermediate postion, wherein rotation of the leadscrew in a first rotary direction causes translational movement of the drive nut in an opening direction for moving the vehicle door from the closed position toward the fully-open position, and wherein rotation of the leadscrew in a second rotary direction causes translational movement of the drive nut in a closing direction for moving the vehicle door toward the closed position.

2. The power swing door actuator of claim 1, wherein a pivotal connection is established between the second link segment of the connector link and a pivot bracket fixedly connected to the vehicle body.

3. The power swing door actuator of claim 1, wherein the housing includes a guide channel within which the connector link moves in response to movement of the vehicle door between the closed and fully-open positions, wherein the door check mechanism includes a biasing arrangement fixed to the housing within the guide channel and defining at least one detent, and a detent pin extending from the first link segment of the connector link, and wherein the detent pin moves relative to the biasing arrangement and is retained within the at least one detent by the biasing load established between the detent pin and the biasing arrangement when the vehicle door is located in the at least one intermediate open position.

4. The power swing door actuator of claim 3, wherein the biasing arrangement includes a pair of laterally-spaced leaf springs secured to the housing and forming the at least one detent therebetween.

5. The power swing door actuator of claim 3, wherein the detent pin is defined by the pivot post extending from the drive nut.

6. The power swing door actuator of claim 3, wherein the pivot aperture formed in the first link segment of the connector link is formed a tubular boss segment, and wherein the boss segment defines the detent pin.

7. The power swing door actuator of claim 1, wherein the housing includes a guide channel within which the connector link moves in response to movement of the vehicle door between the closed and fully-open positions, wherein the door check mechanism includes a check pad formed on or secured within the guide channel and defining at least one detent, and a spring-loaded detent follower extending from one of the drive nut and the first link segment of the connector link, and wherein the detent follower moves relative to the check pad and is retained in the at least one detent by the biasing load established between the check pad and the detent follower when the vehicle door is located in the at least one intermediate open position.

8. The power swing door actuator of claim 7, wherein the check pad defines a first detent and a second detent, wherein the first detent is located so as to engage the detent follower when the vehicle door is located in the at least one intermediate open position, and wherein the second detent is located so as to engage the detent follower when the vehicle door is located in the fully-open position.

9. The power swing door actuator of claim 1, wherein the pivot post extending from the drive nut is retained in the pivot aperture formed in a tubular pivot boss extending from the first link segment of the connector link, wherein the door check mechanism includes at least one detent formed within the housing which is configure to engage the tubular pivot boss when the vehicle door is located in the at least one intermediate open position.

10. The power swing door actuator of claim 1, wherein the door check mechanism includes a spring-loaded follower extending from one of the drive nut and the first link segment of the connector link and at least one retainer detent formed in the housing, and wherein the spring-loaded follower is retained in the retainer detent when the vehicle door is located in the at least one intermediate open position.

11. A power swing door actuator for a vehicle door that is moveable relative to a vehicle body between a closed position and a fully-open position, the power swing door actuator comprising:

a housing mounted to the vehicle door;

an electric motor supported by the housing;

a spindle drive mechanism including a leadscrew supported for rotation by the housing and driven by the electric motor, and a drive nut in threaded engagement with the leadscrew such that rotation of the leadscrew results in translational movement of the drive nut;

an elongated connector link having a first link segment pivotally connected to the drive nut and a second link segment pivotally connected to the vehicle body, wherein the pivotal connection between the drive nut and the connector link includes a pivot post extending outwardly from the drive nut and which is retained in a pivot aperture formed in the first link segment; and a door check mechanism operably disposed between the connector link and the housing and configured to apply a biasing force on the connector link for mechanically holding the vehicle door in an intermediate open position in addition to the fully-open position, wherein the door check mechanism includes a first detent and a second detent associated with the housing and a detent follower associated with the connector link such that the biasing force applied between the first detent and the detent follower acts to hold the vehicle door in the intermediate open position and the biasing force applied between the second detent and the detent follower acts to hold the vehicle door in the fully-open position.

12. The power swing door actuator of claim 11, wherein the first and second detents are defined by a biasing arrangement mounted within the housing and the detent follower is defined by a detent pin extending from the first link segment of the connector link, and wherein the detent pin moves relative to the first and second detents of the biasing arrangement in response to movement of the vehicle door between the intermediate open and fully-open positions.

13. The power swing door actuator of claim 12, wherein the biasing arrangement includes a pair of laterally-spaced leaf springs secured to the housing and forming the first and second detents therebetween, and wherein the detent pin in one of a drive post extending from the drive nut and a drive boss extending from the first link segment of the connector link.

14. The power swing door actuator of claim 11, wherein the pivot aperture is surrounded by a tubular boss extending outwardly from the first link segment of the connector link, and wherein the tubular boss defined the detent follower.

15. A power swing door actuator for a vehicle door that is moveable relative to a vehicle body between a closed position and a fully-open position, the power swing door actuator comprising:

a housing mounted to the vehicle door;

a spindle drive mechanism including a leadscrew rotatably supported by the housing and a drive nut in threaded engagement with the leadscrew such that rotation of the leadscrew causes translational movement of the drive nut relative to the leadscrew;

an electric motor supported by the housing and configured to rotatably drive the leadscrew, wherein rotation of the leadscrew in a first rotary direction causes translational movement of the drive nut in an opening direction for moving the vehicle door from the closed position toward the fully-open position, and wherein rotation of the leadscrew in a second rotary direction causes translational movement of the drive nut in a closing direction for moving the vehicle door toward the closed position;

an elongated connector link having a first link segment pivotally connected to the drive nut and a second link segment pivotally connected to the vehicle body, the drive nut having an outwardly extending pivot post that is retained within a pivot aperture formed in the first link segment of the connector link to establish the pivotal connection between the connector link and the drive nut; and a door check mechanism operably disposed between the connector link and one of the housing and the vehicle door and configured to apply a biasing load on the connector link for mechanically holding the vehicle door in at least one intermediate open position in addition to the fully-open position, wherein the housing includes a guide channel within which the connector link moves in response to movement of the vehicle door between the closed and fully-open positions, wherein the door check mechanism includes a biasing arrangement fixed to the housing within the guide channel and defining at least one detent, and a detent pin extending from the first link segment of the connector link, and wherein the detent pin moves relative to the biasing arrangement and is retained within the at least one detent by the biasing load established between the detent pin and the biasing arranegement when the vehicle door is located in the at least one intermediate position.

16. The power swing door actuator of claim 15, wherein the biasing arrangement includes a pair of laterally-spaced leaf springs secured to the housing and forming the at least one detent therebetween.

17. The power swing door actuator of claim 15, wherein the detent pin is defined by the pivot post extending from the drive nut.

18. The power swing door actuator of claim 15, wherein the pivot aperture formed in the first link segment of the connector link is a tubular boss segment, and wherein the boss segment defines the detent pin.

19. The power swing door actuator of claim 15, wherein the door check mechansim further includes a check pad secured to the guide channel and a spring-loaded detent follower extending from one of the drive nut and the first link segment, and wherein the detent follower moves relative to the check pad and is retained by the at least one detent by the biasing load establsihed between the check pad and the detent follower when the vehicle door is located in the at least one intermediate open position.

* * * * *